US007837515B2

(12) United States Patent
Takahashi et al.

(10) Patent No.: US 7,837,515 B2
(45) Date of Patent: Nov. 23, 2010

(54) COMBINED-TYPE CONNECTOR

(75) Inventors: Toshiharu Takahashi, Makinohara (JP); Kazuto Ohtaka, Makinohara (JP); Hideki Ohsumi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/359,654

(22) Filed: Jan. 26, 2009

(65) Prior Publication Data

US 2009/0197448 A1 Aug. 6, 2009

(30) Foreign Application Priority Data

Jan. 31, 2008 (JP) ..... P2008-020895
Jan. 31, 2008 (JP) ..... P2008-020916

(51) Int. Cl.
*H01R 13/502* (2006.01)

(52) U.S. Cl. ..... 439/701; 439/717

(58) Field of Classification Search ..... 439/217, 439/218, 701, 716, 717
See application file for complete search history.

(56) References Cited

U.S. PATENT DOCUMENTS 4,790,763 A * 12/1988 Weber et al. ..... 439/65
4,797,123 A * 1/1989 Weber ..... 439/717
6,609,929 B2 * 8/2003 Kamarauskas et al. ... 439/541.5

FOREIGN PATENT DOCUMENTS

| | | |
|---|---|---|
| JP | 05-048237 U | 6/1993 |
| JP | 2001-043928 | 2/2001 |
| JP | 2003-249296 | 9/2003 |
| JP | 3098816 U | 10/2003 |

* cited by examiner

*Primary Examiner*—Michael C Zarroli
(74) *Attorney, Agent, or Firm*—Morgan Lewis & Bockius LLP

(57) ABSTRACT

The combined type connector includes a base connector housing and a detachable connector housing. The base connector housing includes a first main body, a boss groove provided on a first outer surface of the first main body, a first guide part provided on the first outer surface; and a first stopping part provided on the first outer surface. The detachable connector housing includes a second main body, a boss provided on a second outer surface of the second main body, a second guide part provided on the second outer surface and a second stopping part provided on the second outer surface. The base connector housing and the detachable connector housing are connected by engaging the boss with the boss groove and pivoting the detachable connector housing about the boss from a first position to a second position so that the first guide part slides along the second guide part and the first stopping part and the second stopping part are engaged so as to stop the detachable connector pivoting at the second position.

19 Claims, 35 Drawing Sheets

21···COMBINED-TYPE CONNECTOR
22···BASE CONNECTOR
23···DETACHABLE CONNECTOR

21···COMBINED-TYPE CONNECTOR
22···BASE CONNECTOR
23···DETACHABLE CONNECTOR

35···BOSS
36···RETAINING GROOVE
37···DETACHABLE-CONNECTOR-SIDE GUIDE RAIL
51···TERMINAL INSERTION FACE

27···BOSS GUIDE GROOVE
28···RETAINING PROJECTION
29···BASE-CONNECTOR-SIDE GUIDE RAIL
30···FITTING ABUTMENT FACE
45···BOSS INSERTION HOLE

40···BOSS TOP SURFACE
41···FLANGE PORTION FIRST CURVED SIDE SURFACE
42···FLANGE PORTION SECOND CURVED SIDE SURFACE
43···BODY PORTION CURVED SIDE SURFACE
44···BASE END PORTION
46···GUIDE GROOVE BOTTOM SURFACE
47···GUIDE GROOVE FIRST SIDE SURFACE
48···GUIDE GROOVE SECOND SIDE SURFACE
49···GUIDE GROOVE OPNING PORTION

81...ELASTICALLY DEFORMING SLIT

107···PRESS FITTING PROTRUSION

114···PRESS FITTING PROTRUSION

156···ERRONEOUS CONNECTION PREVENTING PORTION

281···BASE CONNECTOR
282···DETACHABLE CONNECTOR
286···HOUSING SIDE PORTION
287···BOSS GUIDE GROOVE
288···RETAINING PROTRUSION
289···MATING SIDE CONNECTOR OPPOSING PORTION
291···HOUSING SIDE PORTION
292···BOSS
293···RETAINING GROOVE

COMBINED-TYPE CONNECTOR

BACKGROUND OF THE INVENTION

The present invention relates to a combined-type connector formed by connecting a plurality of connectors to one another into one set.

Hitherto, combined-type connectors are known, in each of which a plurality of connectors are connected to one another in order to improve the handling property of the plurality of connectors. A combined-type connector is disclosed in JP-A-2001-43928 for example, which is described below.

As shown in FIGS. 36A and 36B, a combined-type connector 1 is formed by connecting two connectors 2 and 3 to each other into one set. Each plurality of terminal accommodation chambers 6 or 7 is formed in an associated one of connector housings 4 and 5 of the connectors 2 and 3. Each electric wire 10 or 11 is drawn from an associated one of wire harnesses 8 and 9 into an associated one of the plurality of terminal accommodation chambers 6 and 7. A terminal metal fitting (not shown) to be accommodated in each of the terminal accommodation chambers 6 and 7 is provided at a terminal of an associated one of the electric wires 10 and 11.

The two connectors 2 and 3 are connected to each other by sliding the connector housings 4 and 5 relative to other in a direction of arrow D. In order to perform this connection, a fitting groove 12 is formed in an outer wall of the connector housing 4 of the connector 2, while a T-shaped fitting projection 13 to be fit into the fitting groove 12 is formed on an outer wall of the connector housing 5 of the connector 3. Each of the fitting groove 12 and the fitting projection 13 is formed to extend along a fitting direction (which is the same as the direction designated by arrow D) of an associated one of the connector housings 4 and 5.

When an operation of fitting the fitting projection 13 into the fitting groove 12 in the aforementioned configuration and structure is performed to thereby slide the connector housings 4 and 5 with respect to each other, the connectors 2 and 3 are connected to each other into one set of connectors. Consequently, the assembly of a combined-type connector 1 is completed. The fitting groove 12 and the fitting projection 13 are configured to form a retained state by being fit to each other.

SUMMARY OF THE INVENTION

The dimensions of each part of the connector housings 4 and 5 are set in consideration of fluctuation in the dimensions at manufacturing the connector housing 4 and 5. Accordingly, the dimensions of the fitting groove 12 and the fitting projection 13 are set naturally in consideration of fluctuation in the dimensions of thereof. In the case of setting the dimensions of each part in such a manner, as illustrated in FIG. 36C, a gap 14 is generated between the fitting groove 12 and the fitting projection 13 (because it is impossible to design the fitting groove 12 and the fitting projection 13 to be in a state in which there is no gap therebetween, the gap 14 is consequently generated therebetween). The gap 14 is what is called a retaining looseness. The connector housings 4 and 5 (thus, the connectors 2 and 3) are shaky in directions designated by arrows 15, 16, and 17 (see FIGS. 36B and 36C).

For example, in a case where the connector housings 4 and 5 are shaky in the direction of arrow 16, the connector housings 4 and 5 are displaced with respect to each other, as indicated by dashed lines in the figure. In the case of the looseness indicated by dashed lines, it is difficult to fit each of the connector housings 4 and 5 to the other housing 5 and 4.

At that time, interference is caused between the male terminal fitting of a mating connector (not shown) and the connector housing 5 of the combined-type connector 1. Thus, the conventional combined-type connector 1 has problems that the conventional combined-type connector 1 has poor ability to receive an end of the male terminal metal fitting and that there is a possibility that the terminal metal fittings cannot be brought into normal contact with each other. These problems occur also in the case that the connector housings 4 and 5 are shaky in the direction of arrow 17.

On the other hand, in the case where the connector housings 4 and 5 are shaky in the direction of arrow 15, the combined-type connector is shaky in a fitting direction in which the combined-type connector 1 is fit to the mating connector. Thus, the contact margin between the terminal metal fittings is reduced by an amount of the looseness. Consequently, the conventional combined-type connector has a problem in that conduction failure occurs due to this reduction in the contact margin. The conduction failure affects the performance of the combined-type connector.

Incidentally, in the case of connecting the two connectors combined in the combined-type connector to each other by sliding the two connectors in a direction perpendicular to the fitting direction in which the combined-type connector is fit to the mating connector, (e.g., the connection of the two connectors combined in the combined-type connector illustrated in FIG. 9A), instead of connecting the two connectors combined in the combined-type connector by sliding the two connectors in the fitting direction, the conventional combined-type connector has poor ability to receive an end of the male terminal metal fitting, similarly to the aforementioned case where the connector housings 4 and 5 are shaky in the direction of arrow 16. Consequently, there is a fear that the terminal metal fittings cannot be brought into normal contact with each other.

The invention is accomplished in view of the aforementioned circumstances. An object of the invention is to provide a combined-type connector that can enhance the ability to receive an end of each of the male terminal metal fittings and can prevent the reduction in the contact margin between the terminal metal fittings to thereby improve the performance of the combined-type connector.

To achieve the foregoing object, according to the invention, there is provided a combined-type connector (referred to as a combined-type connector of the invention), which is featured by including a combined type connector including a base connector housing and a detachable connector housing. The base connector housing includes a first main body, a boss groove provided on a first outer surface of the first main body, a first guide part provided on the first outer surface, and a first stopping part provided on the first outer surface. The detachable connector housing includes a second main body, a boss provided on a second outer surface of the second main body, a second guide part provided on the second outer surface, and a second stopping part provided on the second outer surface. The base connector housing and the detachable connector housing are connected by engaging the boss with the boss groove and pivoting the detachable connector housing about the boss from a first position to a second position so that the first guide part slides along the second guide part and the first stopping part and the second stopping part are engaged so as to stop the detachable connector pivoting at the second position.

Preferably, the boss includes a body part integrally provided on the second outer surface, and a flange part integrally provided on the body part.

Preferably, the flange part has a top surface and a flange side surface continuous from the top surface. The body part has a body side surface continuous from the flange side surface. The boss groove includes has a boss insertion hole through which the boss is inserted into the boss groove, a bottom surface on which the top surface slides, a first guide side surface on which the flange side surface slides, and a second guide side surface on which the body side surface slides.

Preferably, the first outer surface has a first aspect on which the boss groove is formed and a second aspect on which a mating terminal insertion hole is provided, wherein the boss insertion hole straddles an edge which is shared by the first and the second aspect of the first outer surface.

Preferably, the top surface has an arc peripheral part and the flange side surface is continuous from the arc peripheral part.

According to the combined-type connector of the invention, the detachable connector rotates around the boss inserted into the boss guide groove. Then, the engagement between the first guide part and the second guide part is caused in process of rotating the detachable connector. Subsequently, when a retained state is formed by the engagement between the first stopping part and the second stopping part, the two connectors, i.e., the base connector and the detachable connector are connected to each other. Thus, a combined-type connector is formed. The combined-type connector is configured so that the engagement between the first guide rail and the second guide rail is released by releasing the retained state and by rotating the detachable connector in a direction opposite to a direction in which the detachable connector is connected to the base connector. In addition, the boss is disengaged from the boss guide groove. Thus, the combined-type connector is disconnected into the two connectors.

An example of the functions of the boss and the boss groove is to restrain displacement in a direction corresponding to the fitting direction, in which the combined-type connector is fit to the mating connector, in the connected state in which the base connector and the detachable connector are connected to each other. Another example is to restrain displacement in a direction in which the base connector and the detachable connector are aligned with each other. On the other hand, an example of the functions of the first guide part and the second guide part is to restrain displacement in a direction corresponding to the direction, in which the combined-type connector is decoupled from the mating connector, by the engagement between the first guide part and the second guide part in the connected state in which the base connector and the detachable connector are connected to each other.

A second aspect of the invention according to the combined-type connector of the invention is featured in that the contact between the boss flange part and the boss housing is tightened when the detachable connector housing pivots about the boss.

According to the second combined-type connector of the invention, tightening is caused as the boss in the boss groove rotates. Consequently, the looseness between the boss and the boss groove is absorbed.

The third aspect of the combined-type connector of the invention is featured in that the boss and the boss groove are formed to be in a press-fit state.

According to the third combined-type connector of the invention, the boss guide groove and the boss are brought into a press-fit state. Thus, no looseness is generated between the boss and the boss guide groove.

The fourth aspect according to the combined-type connector of the invention is featured in that the flange part has a slit so as to alleviate a force caused by tightening.

According to the fourth aspect of combined-type connector of the invention, the boss is inserted into the boss groove while the boss is elastically deformed at the slit. The generation of the press-fit state of the boss and the boss groove can be facilitated by forming the slit.

A fifth aspect according to the combined-type connector of the invention is featured in that the flange part has a protrusion at a periphery of the flange part so that the connection between the boss flange part and the boss housing part is tightened when the detachable connector housing pivots about the boss.

According to the fifth combined-type connector of the invention, when the boss is inserted into the boss groove, a press-fit state is not caused. When the boss is rotated, the looseness between the boss and the boss guide groove is absorbed by the press-fitting protrusion.

A sixth aspect according to the combined-type connector of the invention is featured in that the first and the second guide part are formed so that the contact between the first and the second guide part is tightened when the detachable connector housing pivots about the boss gradually or in a stepwise manner.

According to the sixth aspect of the combined-type connector of the invention, the clearance between the first guide part and the second guide part is sufficiently provided in the beginning of the rotation of the detachable connector. Thus, workability is good. Subsequently, when the connected state between the base connector and the detachable connector is formed, the clearance is reduced. The looseness between the first guide part and the second guide part is absorbed.

The seventh aspect of the combined-type connectors of the invention is featured in that at least one of the first and the second guide part includes a stopper which restrains the rotation of the detachable connector.

According to the seventh aspect of the combined-type connector of the invention, the rotation of the detachable connector is restrained by the abutment between the stopper.

The eighth aspect of the combined-type connectors of the invention is featured in that at least one of the first and the second guide part includes an erroneous connection preventing portion which prevent erroneous connection between different type connectors.

According to the eighth aspect of the combined-type connector of the invention, the non-normal rotation is restrained by the erroneous connection preventing portion. The base connector and the detachable connector are prevented from being erroneously connected to each other. The erroneous connection preventing portion restrains the non-normal rotation and further functions effectively when there is erroneous in types of the base connector and the detachable connector.

The ninth aspect of the combined-type connectors of the invention is featured in that the first stopping part is provided on a half part of the first aspect including the first edge and the second stopping part is provided on a half part of the second aspect including the second edge.

According to the ninth aspect of the combined-type connector of the invention, even when a looseness is generated in a retaining portion between the first stopping part and the second stopping part due to the structure thereof, the generated looseness corresponds to a minute angle in a case where the looseness is represented in terms of an angle in the direction of the rotation. Consequently, an amount of displacement of a male terminal receiving portion in the base connector in the case of using the detachable connector, which is connected by the rotation thereof, as a reference can be suppressed to a small value. The fitting and the electrical connection of the combined-type connector of the invention to the mating connector serving as a connection opponent can be achieved in a favorable condition. In a case where the looseness of the retaining portion is set at a constant amount, the aforementioned minute angle is gradually decreased as the retaining portion goes away from the boss and the boss guide groove (the center of the rotation), or as the boss and the boss guide groove come close to the face (i.e., the fitting abutment face) provided with the male terminal receiving portion.

The tenth aspect of the combined-type connector of the invention is featured in that the flange part has a semi-circle shape and the boss insertion hole has a boss rotation supporting portion functioning as a fulcrum for the boss rotation.

According to the tenth aspect of the combined-type connector of the invention, an advantage in enhancing the ability to receive an end of the terminal metal fitting can be achieved. Consequently, another advantage in surely implementing the normal contact between the terminal metal fittings can be achieved. In addition, according to the invention, an advantage in preventing the reduction in the contact margin between the terminal metal fittings can be achieved to thereby enhance the performance of the combined-type connector.

According to the combined-type connector of the invention, an advantage in enhancing the ability to receive an end of each of the terminal metal fittings can be achieved. Consequently, another advantage in surely implementing the normal contact between the terminal metal fittings can be achieved. In addition, according to the invention, an advantage in preventing the reduction in the contact margin between the terminal metal fittings can be achieved to thereby enhance the performance of the combined-type connector.

According to the second or third aspect of the combined-type connector of the invention, an advantage in preventing the boss from being shaky in the boss groove can be achieved. The invention can achieve other advantages in surely implementing the normal contact between the terminal metal fittings and in preventing the reduction in the contact margin therebetween.

According to the fourth aspect of the combined-type connector of the invention, an advantage in smoothly forming the press-fit state of the boss and the boss groove can be achieved.

According to the fifth aspect of the combined-type connector of the invention, advantages in forming the press-fit state and in preventing the boss from being shaky in the boss guide groove can be achieved. In addition, another advantage in taking workability into consideration at the formation of the press-fit state can be achieved.

According to the sixth aspect of the combined-type connector of the invention, an advantage in preventing occurrence of the looseness between the first guide rail and the second guide rail can be achieved. In addition, another advantage in taking workability into consideration at the formation of the connected state can be achieved. The invention can achieve other advantages in surely implementing the normal contact between the terminal metal fittings and in preventing the reduction in the contact margin therebetween.

According to the seventh aspect of the combined-type connector of the invention, an advantage in forming the connected state between the base connector and the detachable connector at a predetermined position can be achieved. Consequently, the invention can achieve an advantage in surely implementing the normal contact between the terminal metal fittings.

According to the eighth aspect of the combined-type connector of the invention, an advantage in preventing occurrence of erroneous connection of the base connector and the detachable connector can be achieved.

According to the ninth aspect of the combined-type connector of the invention, in the case of using the detachable connector as a reference, an advantage in suppressing an amount of displacement of the male terminal fitting in the base connector from the reference to a small amount can be achieved. Consequently, the invention can achieve an advantage in further enhancing the ability to receive an end of each of terminal metal fittings and in more surely implementing the normal contact between the terminal metal fittings.

According to the tenth aspect of the combined-type connector of the invention, an advantage in enhancing the ability to receive an end of the terminal metal fitting can be achieved. Consequently, another advantage in surely implementing the normal contact between the terminal metal fittings can be achieved. In addition, according to the invention, an advantage in preventing the reduction in the contact margin between the terminal metal fittings can be achieved to thereby enhance the performance of the combined-type connector.

BRIEF DESCRIPTION OF DRAWINGS

FIG. 2A is a perspective view illustrating a state in which a fitting abutment face of the base connector is shown at a front side. FIG. 2B is a perspective view illustrating a state in which a terminal insertion face of the base connector is shown at a rear side.

FIG. 8A is a front view illustrating a combined-type connector. FIG. 8B is a cross-sectional view taken on line E-E shown in FIG. 8A. FIG. 8C is a front view illustrating the combined-type connector. FIG. 8D is a cross-sectional view taken on line F-F shown in FIG. 8C.

FIG. 15A is a view taken from the front side of the base connector. FIG. 15B is a cross-sectional view taken on line A-A shown in FIG. 15A. FIG. 15C is an enlarged cross-sectional view illustrating the boss and the boss guide groove.

FIG. 16A is a view taken from the front side of the base connector FIG. 16B is a cross-sectional view taken on line B-B shown in FIG. 16A. FIG. 16C is an enlarged cross-sectional view illustrating the boss and the boss guide groove.

FIG. 17A is a view taken from the front side of the base connector. FIG. 17B is a cross-sectional view taken on line C-C shown in FIG. 17A.

FIG. 20A is a view taken from the front side of the base connector FIG. 20B is a cross-sectional view taken on line G-G shown in FIG. 20A.

FIG. 21A is a view taken from the front side of the base connector FIG. 21B is a cross-sectional view taken on line H-H shown in FIG. 21A.

FIG. 22A is a view taken from the front side of the base connector. FIG. 22B is a cross-sectional view taken on line 1-1 shown in FIG. 22A.

FIGS. 28A and 28B are perspective views each illustrating a state before a base connector and a detachable connector are connected to each other. FIG. 28C is a perspective view illustrating a state in process of rotating the detachable connector.

FIG. 29A is a plan view illustrating a state before the base connector and the detachable connector are connected to each other. FIG. 29B is an enlarged view illustrating a part A shown in FIG. 29A. FIG. 29C is a perspective view illustrating a boss and a boss guide groove in the state before the base connector and the detachable connector are connected to each other.

FIG. 30A is a front view illustrating a state of the boss and the boss guide groove before the boss and the boss guide groove are connected to each other. FIG. 30B is a cross-sectional view illustrating a state in which the boss is inserted into the boss guide groove. FIG. 30C is a cross-sectional view illustrating a state in process of rotating the boss. FIG. 30D is a cross-sectional view illustrating a state in which the rotation of the boss is finished.

FIG. 31A is a front view illustrating a state of the base connector and the detachable connector in a state in which the boss is inserted into the boss guide groove. FIG. 31B is a cross-sectional view (including an enlarged view illustrating a primary part), which is taken on line B-B shown in FIG. 31A.

FIG. 32A is a front view illustrating a state in process of rotating the detachable connector. FIG. 32B is a cross-sectional view (including an enlarged view illustrating a primary part), which is taken on line C-C shown in FIG. 32A.

FIG. 33A is a front view illustrating a state in which the rotation of the detachable connector is finished. FIG. 33B is a cross-sectional view (including an enlarged view illustrating a primary part), which is taken on line D-D shown in FIG. 33A.

FIG. 36A is a perspective view illustrating a state before a base connector and a detachable connector are connected to each other. FIG. 36B is a perspective view illustrating a combined-type connector in a state after the base connector and the detachable connector are connected to each other. FIG. 36C is an explanatory view relating to a looseness.

DETAIL DESCRIPTION OF THE PREFERRED EMBODIMENT

Figure 1:
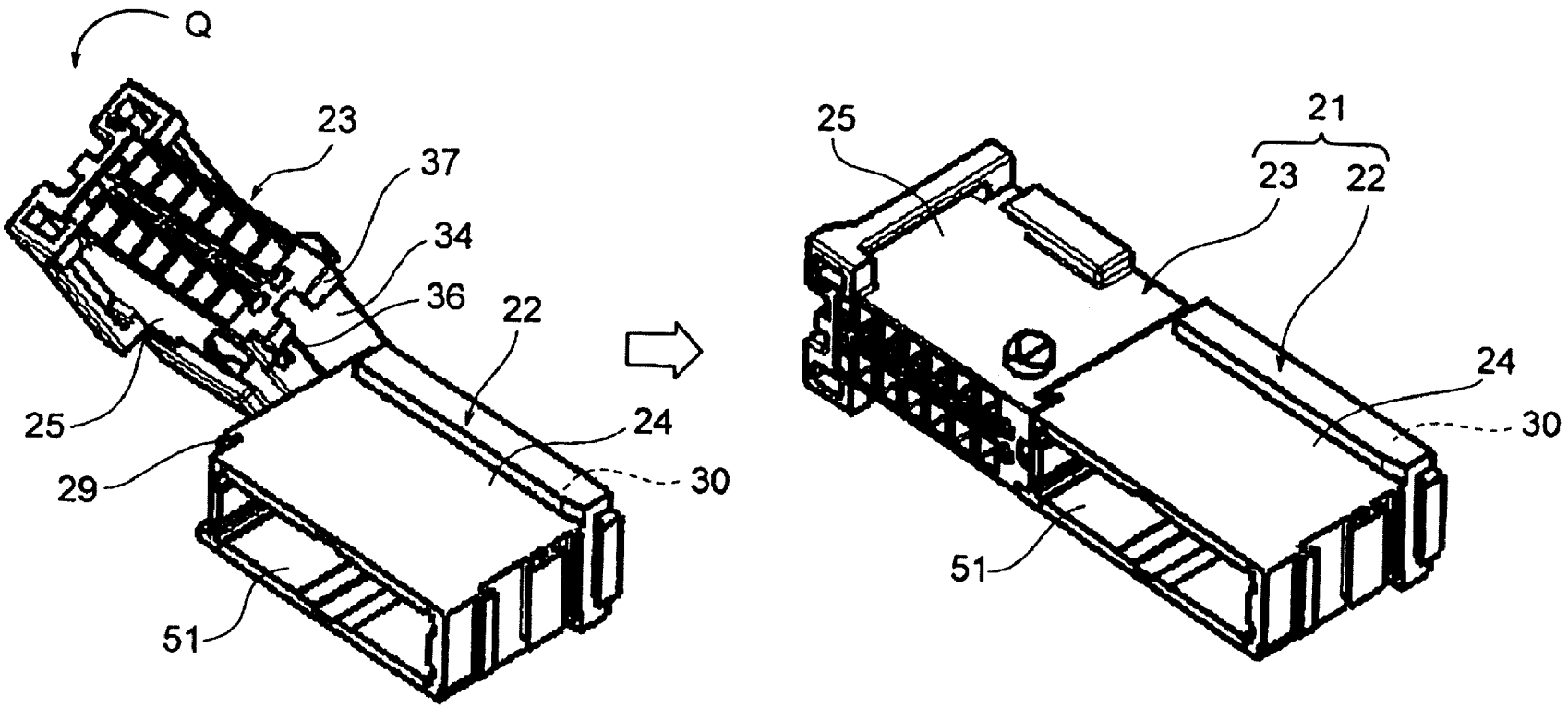
FIG. 1 is a perspective view illustrating an embodiment (i.e., a first embodiment) of a combined-type connector of the invention.
Figure 2B:
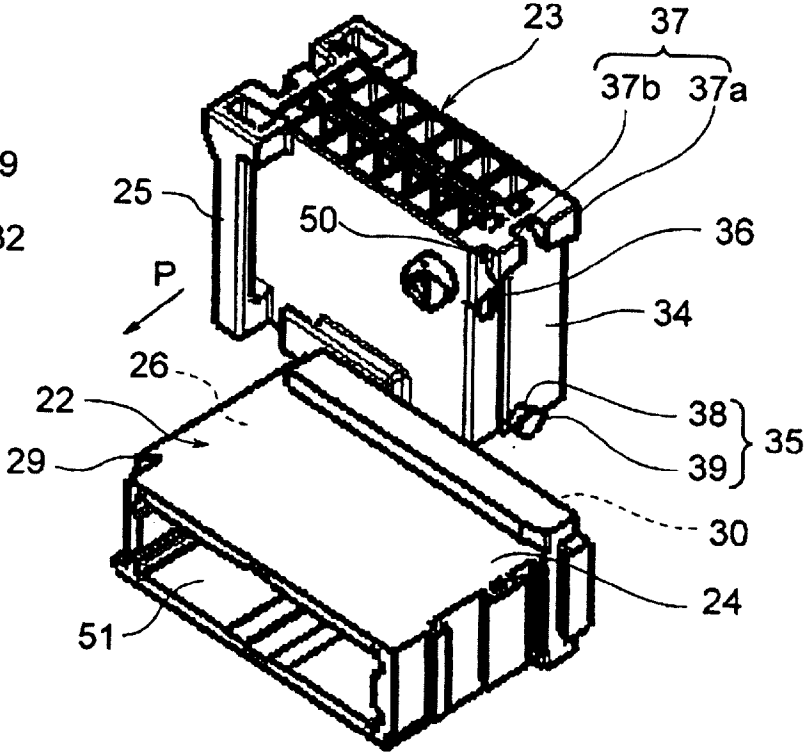
FIGS. 2A and 2B are perspective views each illustrating a state in which a base connector and a detachable connector are separated from each other before being connected to each other.
Figure 2A:
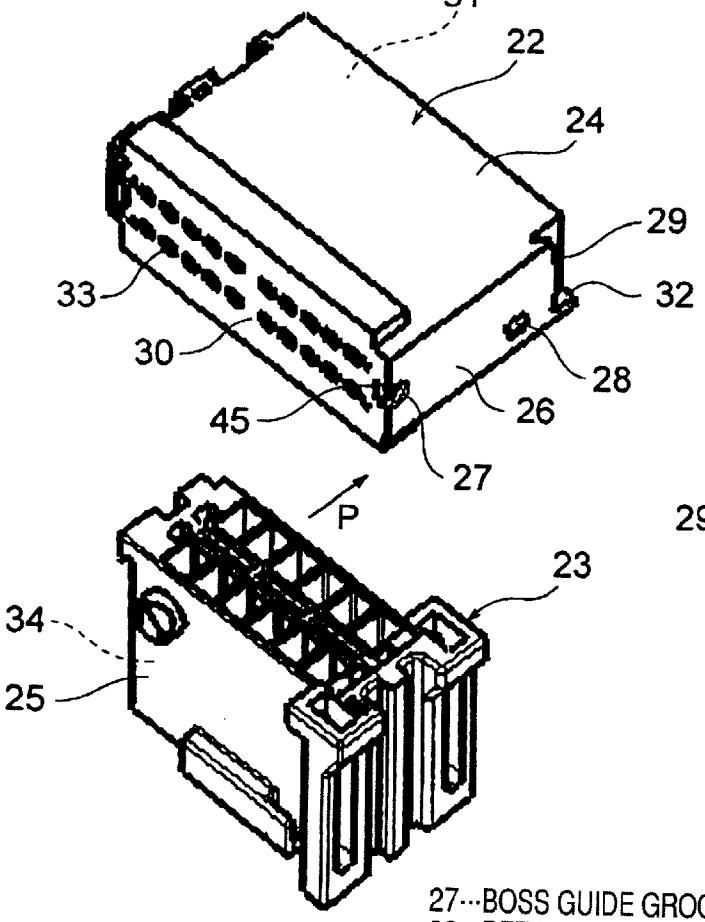
Figure 3:
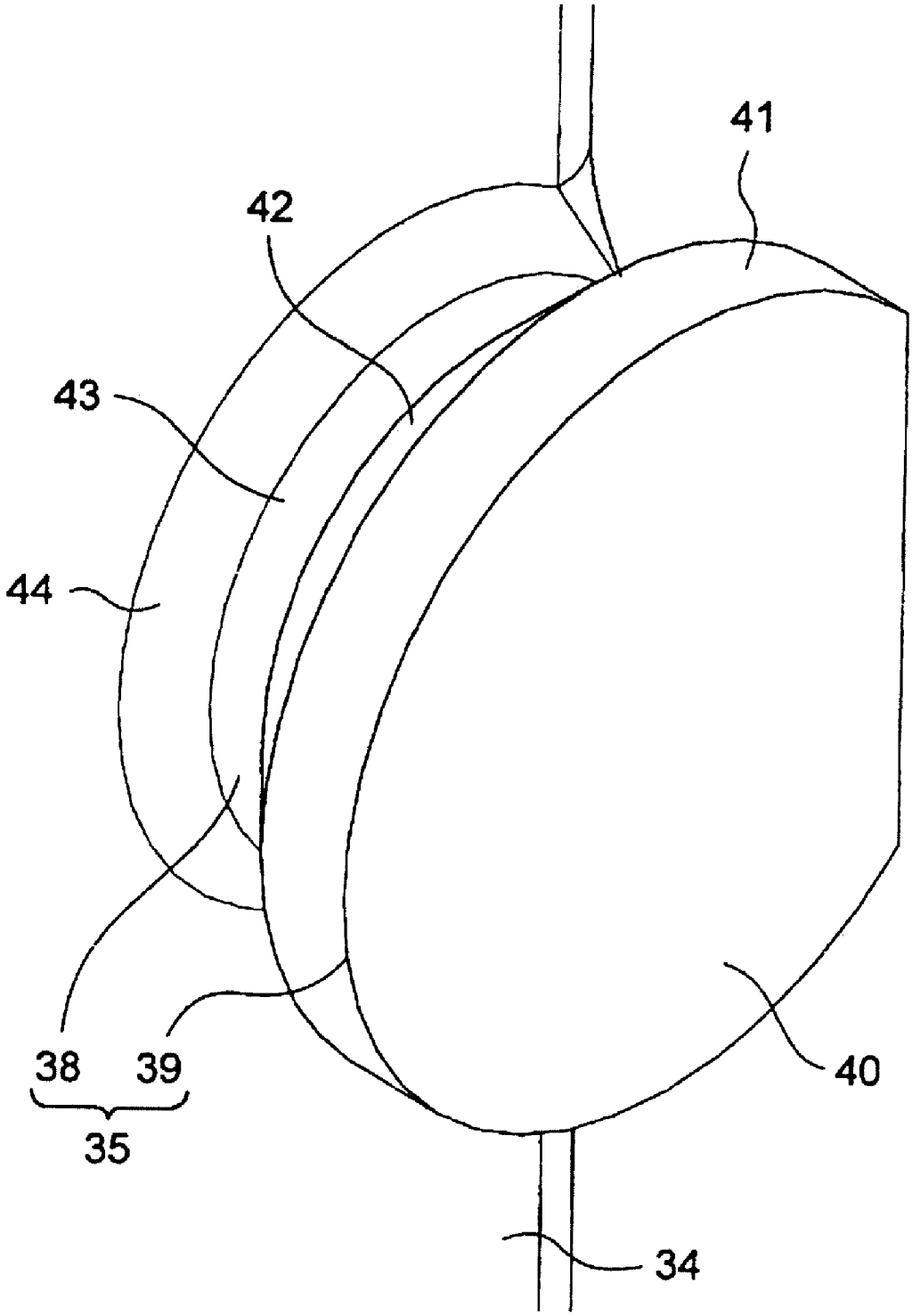
FIG. 3 is an enlarged perspective view illustrating a boss.
Figure 4:
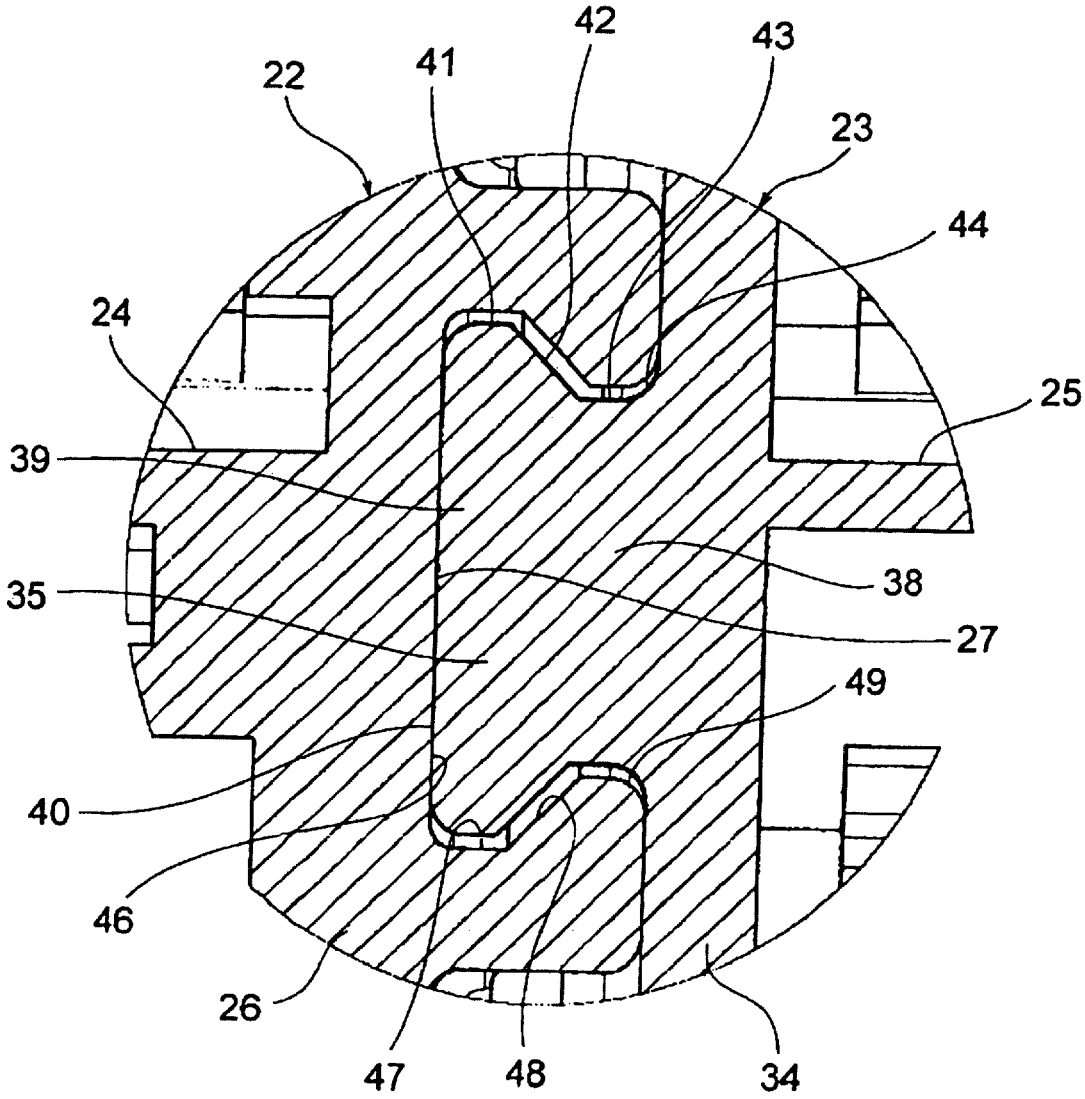
FIG. 4 is an enlarged cross-sectional view illustrating a boss and a boss guide.
Figure 5:
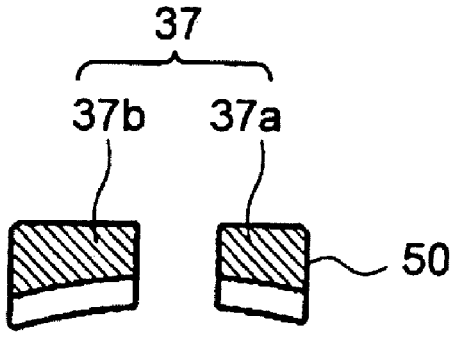
FIG. 5 is a cross-sectional view illustrating a state just before the detachable connector is rotated with respect to the base connector.
Figure 5:
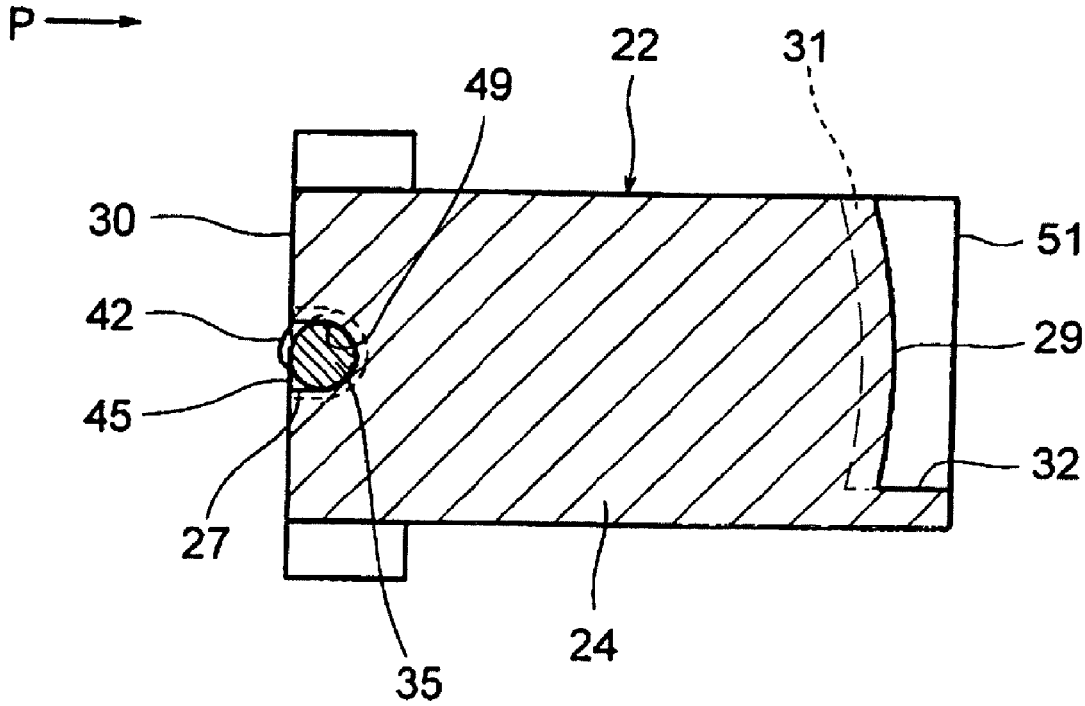
Figure 6:
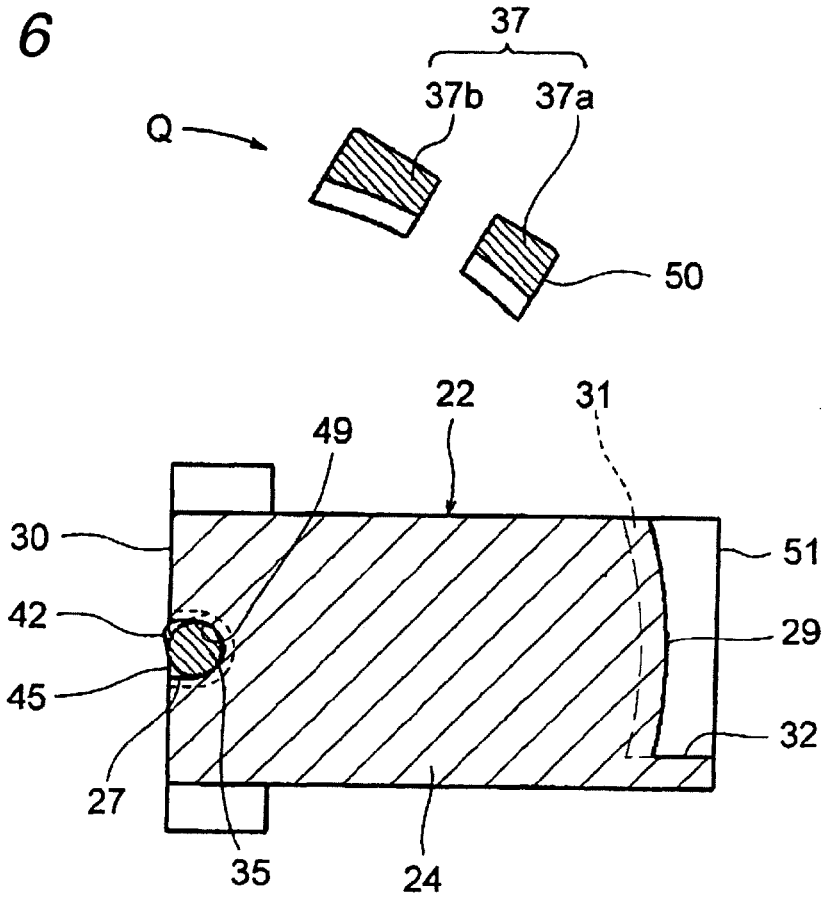
FIG. 6 is a cross-sectional view illustrating a state in process of rotating the detachable connector with respect to the base connector.
Figure 7:
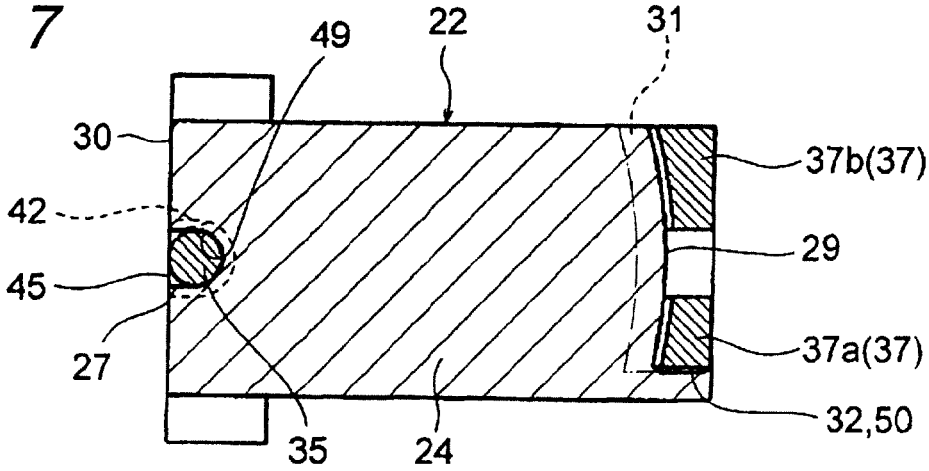
FIG. 7 is a cross-sectional view illustrating a state in which the base connector and the detachable connector are aligned with and connected to each other.
Figure 8B:
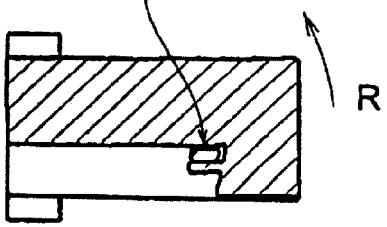
FIGS. 8A to 8D are explanatory views each illustrating an amount of displacement of a mating terminal receiving portion.
Figure 8D:
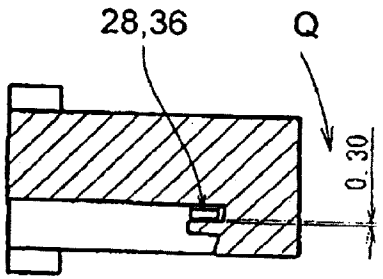
Figure 8A:
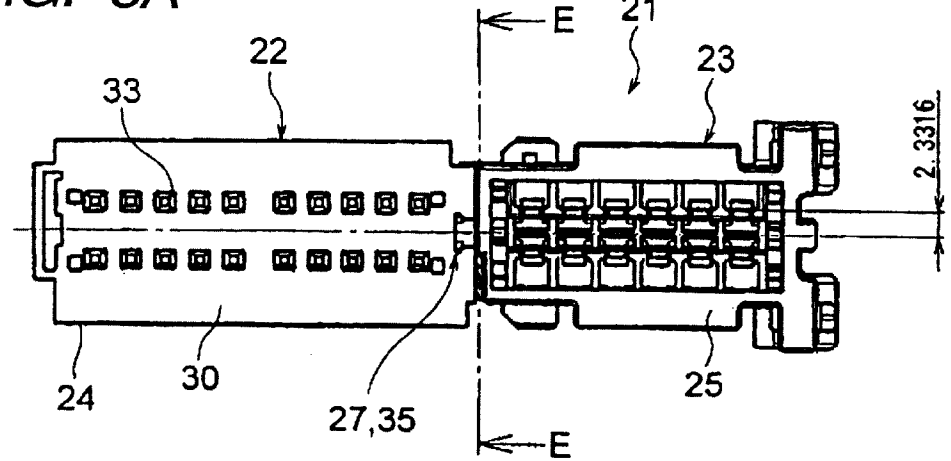
Figure 8C:
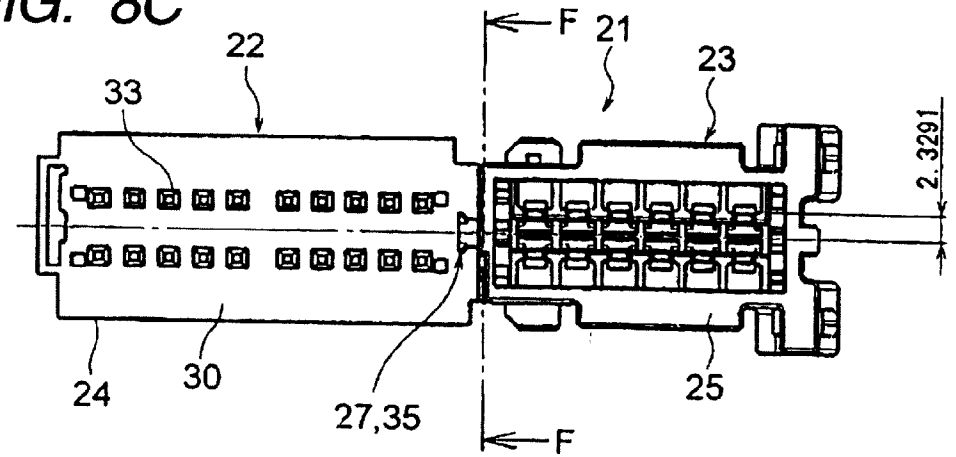

Embodiments of the invention are described by referring to the accompanying drawings. FIG. 1 is a perspective view illustrating an embodiment (a first embodiment) of a combined-type connector of the invention. Further, FIGS. 2A and 2B are perspective views each illustrating a state in which a base connector and a detachable connector are separated from each other before the base connector and the detachable connector are connected to each other. FIG. 3 is an enlarged perspective view illustrating a boss. FIG. 4 is an enlarged cross-sectional view illustrating a boss and a boss guide groove. FIG. 5 is a cross-sectional view illustrating a state just before the detachable connector is rotated with respect to the base connector. FIG. 6 is a cross-sectional view illustrating a state in process of rotating the detachable connector with respect to the base connector. FIG. 7 is a cross-sectional view illustrating a state in which the base connector and the detachable connector are aligned with and connected to each other.

As illustrated in FIG. 1, a combined-type connector 21 is formed by connecting the base connector 22 and the detachable connector 23 to each other in order to improve the handling property of a plurality of connectors. More specifically, the combined-type connector 21 is formed by rotating the detachable connector 23 with respect to the base connector 22 (in the present embodiment, the detachable connector 23 is turned by substantially 90°) so as to put these connectors 22 and 23 into a parallel condition, thereby connecting the base connector 22 and the detachable connector 23. That is, the combined-type connector 21 is formed, as illustrated in FIG. 1, by connecting the connectors 22 and 23 through the rotation of the detachable connector 23 with respect to the base connector 22. In addition, the combined-type connector 21 is formed to be able to be separated by rotating the detachable connector 23 in a reverse direction from a connected state into the base connector 22 and the detachable connector 23.

As illustrated in FIGS. 1 and 2, the base connector 22 is configured to be provided with a base connector housing 24 made of an insulating synthetic resin and with a terminal metal fitting (not shown) housed and retained in the base connector housing 24. Similarly, the detachable connector 23 is configured to be provided with a base connector housing 25 made of an insulating synthetic resin and with a terminal metal fitting (not shown) housed and retained in the base connector housing 25.

A boss guide groove 27, a retaining protrusion 28 and a base-connector-side guide rail 29 are formed in a housing side portion 26 that is provided in the base connector housing 24 at the side of the detachable connector 23. The boss guide groove 27 is arranged and formed to extend to a part of a fitting abutment face 30 opposed to a mating connector (not shown). The retaining protrusion 28 is arranged and formed at a position away from the boss guide groove 27. The base-connector-side guide rail 29 is arranged and formed at a position more apart from the boss guide groove 27 than the retaining protrusion 28.

The base-connector-side guide rail 29 is formed like a circular-arc. More specifically, the base-connector-side guide rail 29 is shaped like a circular-arc-like curved groove, as illustrated in FIG. 5. The base-connector-side guide rail 29 is formed so as to protrude from or be recessed from the housing side portion 26 depending on the structure of the combined-type connector 21. An inserting/removing opening portion 31 for a detachable-connector-side guide rail to be described below is formed at one end portion of the base-connector-side guide rail 29. Further, a stopper face 32, on which the detachable-connector-side guide rail to be described below abuts, is formed at the other end portion of the base-connector-side guide rail 29. The retaining protrusion 28 is arranged and formed in the vicinity of the stopper face 32 (see FIG. 2). The stopper face 32 is formed to be able to restrain the rotation in the connecting direction of the detachable connector 23 (in addition, a rotation end position can be found). Further, the retaining protrusion 28 is formed to be able to restrain the rotation in a detaching direction of the detachable connector 23 by engaging with a retaining groove (to be described below) of the detachable connector 23 (incidentally, the formation of the stopper face 32 is assumed to be able to be optional, because the rotation of the detachable connector 23 in the connecting direction and the detaching direction can be restrained by providing a retained state using the retaining protrusion 28 and the retaining groove which is described below).

The fitting abutment face 30 is formed to extend perpendicularly to the housing side portion 26. A plurality of mating terminal insertion holes 33 are formed in the fitting abutment face 30. A tapered portion (not designated with a specific reference numeral) is formed in each of the mating terminal insertion holes 33 to surround a through hole portion (see FIGS. 8A to 8D). A mating connector terminal metal fitting (not shown) is guided into the base connector housing 24 by the tapered portion formed in each of the mating terminal insertion holes 33 (an end portion of each of the terminal metal fittings is received by the tapered portion (functioning as a mating terminal receiving portion) of an associated one of the mating terminal insertion holes 33). The terminal metal fittings cannot be received in a case where there is a relatively large looseness, similarly to the conventional combined-type connector. However, according to the invention, the combined-type connector has a structure enabled to suppress looseness (i.e., a retaining looseness) as much as possible. The invention is featured in a structure that can enhance the ability to receive an end of each of terminal metal fittings and that can prevent reduction in the contact margin between the terminal metal fittings.

The boss guide groove 27 formed in the base connector 22 is described below.

A boss 35 to be inserted into the boss guide groove 27, a retaining groove 36 to be engaged with the retain protrusion 28, and a detachable-connector-side guide rail 37 to be engaged with the base-connector-side guide rail 29 are formed in the housing side portion 34 that is a part of the detachable-connector-side housing 25, which is provided at the side of the base connector 22. The boss 35 is arranged and formed at a position adjusted to that of the boss guide groove 27. The retaining groove 36 is arranged and formed at a position adjusted to that of the retaining protrusion 28. The detachable-connector-side guide rail 37 is arranged and formed at a position adjusted to that of the base-connector-side guide rail 29.

As illustrated in FIGS. 3 and 4, the boss 35 includes a boss body portion 38 and a flange portion 39 that is continuous with one end side of the boss body portion 38. The boss 35 is formed to have a shape of the flange portion 39 larger than that of the boss body portion 38.

The boss 35 includes a flat boss top surface 40 formed at an end of the protrusion, a flange portion first curved side surface (flange portion side surface) 41 that is continuous with a circular-arc portion of the boss top surface 40, a flange portion second curved side surface (flange portion side surface) 42 which is continuous with the flange portion first curved side surface 41 and is cross-sectionally taperedly inclined, and a body portion curved side surface (body portion side surface) 43 that is continuous with the flange portion second curved side surface 42. Reference numeral 44 designates a base end portion of the boss 35. The boss 35 is set so that the height from the base end portion 44 to the boss top surface 40 is equal to a predetermined height. The boss 35 is set to be rotated by being inserted into the boss guide groove 27. Incidentally, the shape of the flange portion second curved side surface 42 can be a shape that is cross-sectionally inclined like a circular-arc, or that is cross-sectionally inclined like a hook, in addition to a cross-sectionally taperedly inclined shape. The shape of the flange portion second curved side surface 42 is not limited to a specific shape, as long as the shape thereof is adapted such that the surface 42 abuts against the boss guide groove 27 thereby to restrain the detachable connector 23 from moving in a boss protruding direction in which the boss 35 protrudes.

The boss guide groove 27 of the base connector 22 includes a boss insertion hole 45 opened in the fitting abutment face 30 (see FIG. 2) and a boss housing portion. The boss housing portion includes a guide groove bottom surface 46 which the boss top surface 40 slides on or is opposed to, a guide groove first side surface 47 which the flange portion first curved side surface 41 slides or is opposed to, a cross-sectionally taperedly inclined guide groove second side surface 48 which the flange portion second curved side surface 42 slides on or is opposed to, and a guide groove opening portion 49 which the body portion curved side surface 43 or the base end portion 44 slides on or is opposed to as illustrated in FIG. 4. Each of the side surfaces is formed like a circular-arc. The guide groove second side surface 48 is formed into a shape adjusted to that of the flange portion second curved side surface 42. In the boss housing portion, the boss 35 is inserted and holded.

Incidentally, the flange portion second curved side surface 42 of the boss 35 and the boss guide groove second side surface 48 of the boss guide groove 27 are not formed into a simply cross-sectionally taperedly inclined shape, and are formed into a shape (i.e., a shape enabling a set of the boss and the boss guide groove to function as a tightening structure portion) that causes tightening between the boss 35 and the boss guide groove 27 (however, this shape is only one example, and other examples will be described below) when the boss 35 is rotated. Due to occurrence of the tightening between the boss 35 and the boss guide groove 27, the generation of looseness at this part (more specifically, looseness in the boss protruding direction) can surely be restrained. An example of the shape enabling a set of the boss and the boss guide groove to function as a tightening structure portion is a shape adapted so that a gap is generated between the flange portion second curved side surface 42 and the guide groove second side surface 48, which are cross-sectionally taperedly inclined, just after the boss 35 is inserted into the boss guide groove 27, that this gap gradually decreases with the rotation of the boss 35, and that finally, the cross-sectionally taperedly inclined surfaces push each other and are attached tightly to each other. In this case, it is advisable that for example, the inclination angle of one of the cross-sectionally taperedly inclined surfaces is set at a constant value, and that the inclination angle of the other cross-sectionally taperedly inclined surface is set to be variable.

The detachable-connector-side guide rail 37 is formed into a groove-like shape adapted to be curved like a circular-arc, as illustrated in FIG. 5, and to engage with the base-connector-side guide rail 29. The detachable-connector-side rail 37 is formed so as to protrude from or the recessed from the housing side portion 34 depending on the structure of the combined type connector 21. The detachable-connector-side guide rail 37 is formed into a shape divided in two parts (detachable-connector-side guide rails 37*a* and 37*b*) by performing die-cutting for forming the boss 35. A stopper face 50 is formed on the detachable-connector-side guide rail 37*a*. The stopper face 50 is adapted to abut against the stopper surface 32 of the base-connector-side guide rail 29. A retaining groove 36 is arranged and formed in the vicinity of the stopper face 50 (see FIG. 2).

As illustrated in FIG. 2, the boss 35 and the boss guide groove 27 are arranged and formed in the vicinity of the fitting abutment face 30 in the present embodiment (the boss 35 and the boss guide groove 27 are formed in the vicinity of the fitting abutment face 30 in order to assure a large terminal receiving margin, and however, the positions of the boss 35 and the boss guide groove 27 are not limited to those illustrated in the figure). The boss 35 and the boss guide groove 27 are arranged and formed at a central position in the direction of height of each of the housing side portions 34 and 26 (depend on the position of one of the mating terminal insertion holes 33) in the present embodiment.

Each of the retaining protrusion 28 and the retaining groove 36 is arranged and formed to be positioned on a rotational trajectory around the boss 35 and the boss guide groove 27. Each of the retaining protrusion 28 and the retaining groove 36 is arranged and formed at a position away from the associated one of the boss 35 and the boss guide groove 27. In the present embodiment, each of the retaining protrusion 28 and the retaining groove 36 is arranged at a side that is opposite to the fitting abutment face 30 and that is closer to the terminal insertion face 51.

Each of the base-connector-side guide rail 29 and the detachable-connector-side guide rail 37 is arranged and formed to be positioned on a rotational trajectory around the boss 35 and the boss guide groove 27 in the present embodiment. Each of the base-connector-side guide rail 29 and the detachable-connector-side guide rail 37 is arranged and formed at a position away from the associated one of the boss 35 and the boss guide groove 27. In the present embodiment, each of the base-connector-side guide rail 29 and the detachable-connector-side guide rail 37 is arranged and formed at a side that is closer to the terminal insertion face 51 than the retaining protrusion 28 and the retaining groove 36.

Next, a process of connecting the base connector 22 and the detachable connector 23 to each other is described hereinafter according to the aforementioned configuration and structure.

As illustrated in FIGS. 2A and 2B, the detachable connector 23 is erected by 90° with respect to the base connector 22. Then, the detachable connector 23 is moved in the direction of arrow P. When the detachable connector 23 is moved in the direction of arrow P, the boss 35 is inserted into the boss guide groove 27 of the base connector 22, as illustrated in FIG. 5. The boss 35 is passed through the boss insertion hole 45 and is guided into the boss guide groove 27. At that time, the boss top surface 40 of the boss 35 slides on the guide groove bottom surface 46. Further, the body portion curved side surface 43 and the base end portion 44 slide on the guide groove opening portion 49 (regarding each part of the boss 35 and the boss guide groove 27, see FIG. 4, and incidentally, regarding the aforementioned sliding operations, it is assumed that the boss 35 and the boss guide groove 27 are not put into a state, in which each of the boss 35 and the boss guide groove 27 slides on an associated one of all of the surfaces of the boss guide groove 27, due to the structure of the combined-type connector, and that an extremely small gap is generated between one of all of the surfaces of the boss 35 and one of all of the surfaces of the boss guide groove 27).

As illustrated in FIGS. 1 and 6, the boss 35 rotates when the detachable connector 23 is rotationally moved in the connecting direction designated by arrow Q. At that time, the boss 35 is adapted so that the boss top surface 40 slides on the guide groove bottom surface 46, that the flange portion first curved side surface 41 slides on the guide groove first side surface 47, that the flange portion second curved side surface 42 slides on the guide groove second side surface 48, and that the body portion curved side surface 43 and the base end portion 44 slide on the guide groove opening portion 49 (see FIG. 4).

As illustrated in FIGS. 1 and 7, the detachable connector 23 is rotated with respect to the base connector 22 to a position in which the detachable connector 23 and the base connector 22 are in a parallel state. Consequently, the boss 35 is adapted so that the boss top surface 40 further slides on the guide groove bottom surface 46, that the flange portion first curved side surface 41 further slides on the guide groove first side surface 47, that the flange portion second curved side surface 42 further slides on the guide groove second side surface 48, and that the body portion curved side surface 43 and the base end portion 44 further slide on the guide groove opening portion 49.

Further, when the detachable connector 23 is rotated with respect to the base connector 22 to the position in which the detachable connector 23 and the base connector 22 are in the parallel state, the detachable-connector-side guide rail 37 is inserted into an opening portion 31 of the base-connector-side guide rail 29 at that time. Then, the detachable-connector-side guide rail 37 slides to a position in which the detachable-connector-side guide rail 37 abuts against the stopper face 32, while the detachable-connector-side guide rail 37 engages with the base-connector-side guide rail 29. When the stopper face 50 of the detachable guide rail 37 abuts against the stopper surface 32 of the base-connector-side guide rail 29, the retaining groove 36 of the detachable connector 23 is resultantly caught on the retaining protrusion 28 of the base connector 22. Thus, a retained state is caused. Consequently, the detachable connector 23 and the base connector 22 are completely connected to each other. Accordingly, the formation of the combined-type connector 21 is completed.

Upon completion of forming the combined-type connector 21, the displacement of the combined-type connector 21 in a direction corresponding to a fitting direction, in which a mating connector (not shown) is fit to the combined-type connector 21, is restrained by the boss 35 and the boss guide groove 27. In addition, the displacement the combined-type connector 21 in a direction, in which the base connector 22 and the detachable connector 23 are aligned with each other, is restrained. Further, the displacement of the combined-type connector 21 in a direction corresponding to a decoupling direction, in which the combined-type connector 21 and the mating connector (not shown) are decoupled from each other, is restrained by the engagement between the base-connector-side guide rail 29 and the detachable-connector-side guide rail 37. Moreover, the rotation of the detachable connector 23 is restrained by the retained state that is formed by the retaining protrusion 28 and the retaining groove 36. Thus, the displacement the combined-type connector 21 in the fitting direction, the decoupling direction, and the direction perpendicular to the direction, in which the base connector 22 and the detachable connector 23 are aligned with each other, is restrained. Accordingly, the base connector 22 and the detachable connector 23 are put into a connected state in which these connectors are difficult to be shaky in each of the aforementioned directions. The combined-type connector 21 is formed in such a connected state.

The combined-type connector 21 can suppress the looseness in a connected state in which the terminal metal fittings are connected to each other, to be smaller than that in the case of the conventional combined-type connector. Consequently, the present embodiment can achieve an effect of preventing reduction in the contact margin between the terminal metal fittings.

Figure 9A:
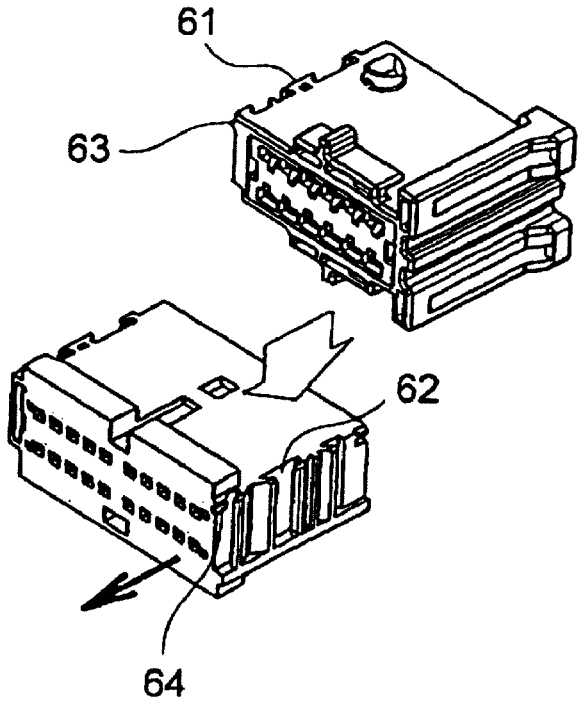
FIGS. 9A to 9C are explanatory views each illustrating a comparative example of the combined-type connector shown in FIGS. 8A to 8D, which concern a retaining looseness.
Figure 9B:
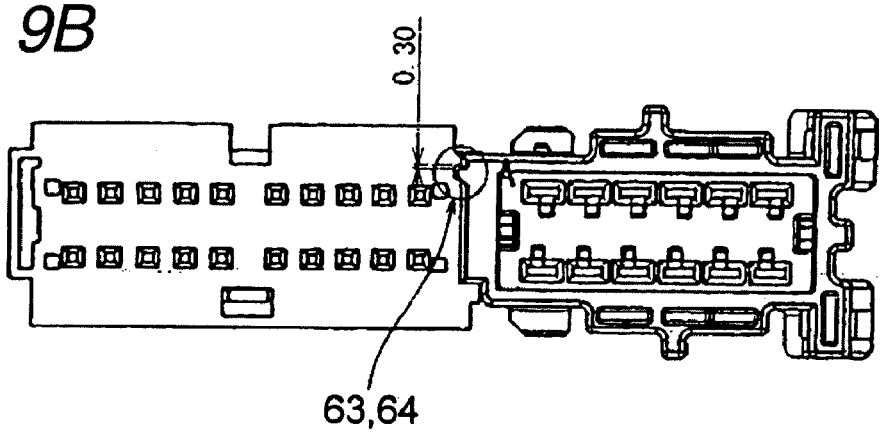
Figure 9C:
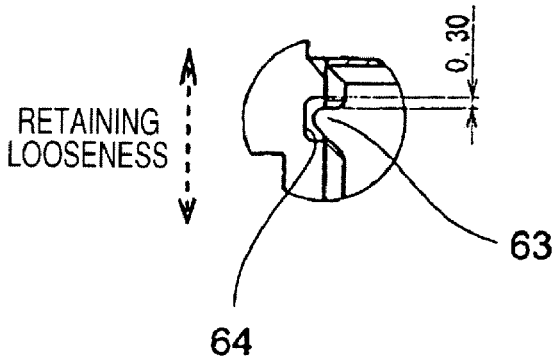

Next, when the detachable connector 23 connected by rotation is regarded as a standard, it is described hereinafter how an amount of displacement of the mating terminal receiving portion in the base connector 22 is made small. FIGS. 5A to 8D are explanatory views each illustrating an amount of displacement of the mating terminal receiving portion of the combined-type connector 21 according to the invention. FIGS. 9A to 9C are explanatory views illustrating a comparative example of the combined-type connector shown in FIGS. 8A to 8D, which concerns a retaining looseness.

As illustrated in FIGS. 8A to 8D, a retaining looseness in the retained state of the retaining protrusion 28 and the retaining groove 36, which serve as a portion for restraining the rotation of the detachable connector, is set at 0.30 mm. When the detachable connector 23 is shaky in the disconnecting direction (disengaging direction) designated by arrow R in the case of setting the retaining looseness at such a value, the dimension of the position of the mating terminal receiving portion with respect to the center line in a horizontal direction of the combined-type connector 21 is 2.3316 mm. On the other hand, when the detachable connector 23 is shaky in the connecting direction designated by arrow Q in the case of setting the retaining looseness at such a value, the dimension of the position of the mating terminal receiving portion with respect to the center line in the horizontal direction of the combined-type connector 21 is 2.3291 mm. Accordingly, it is found that an amount of displacement (i.e., a displacement amount) of the position of the mating terminal receiving portion is 0.0025 mm (=23316−2.3291). As the combined-type connector 21 employs a method of connecting the base connector 22 and the detachable connector 23 with each other by the rotation of the detachable connector 23, and the retaining protrusion 28 and the retaining groove 36 are moved away from the center of the rotation, even in the case of setting the retaining looseness at 0.30 mm, an amount of the caused displacement of the mating terminal receiving portion is only 0.0025 mm. Therefore, the amount of the displacement is small. Consequently, the fitting and the electrical connection of the combined-type connector 21 to the mating connector can be achieved in a favorable state.

As illustrated in FIGS. 9A to 9C, in a slide fitting structure in which the fitting protrusion 61 is fit to the fitting groove 62, a retaining looseness in the retained state of the retained state of the retaining protrusion 63 and the retaining groove 64 is set at 0.30 mm, similarly to the case illustrated in FIGS. 8A to 8D, the position of the mating terminal receiving portion is displaced by a retaining looseness of 0.30 mm.

As is understood according to the aforementioned amount of the displacement, the invention can suppress the amount of the displacement of the mating terminal receiving portion to a small value, as compared with the conventional combined-type connector. Consequently, the invention can achieve an effect of enhancing the reliability of terminal metal fittings.

Figure 10:
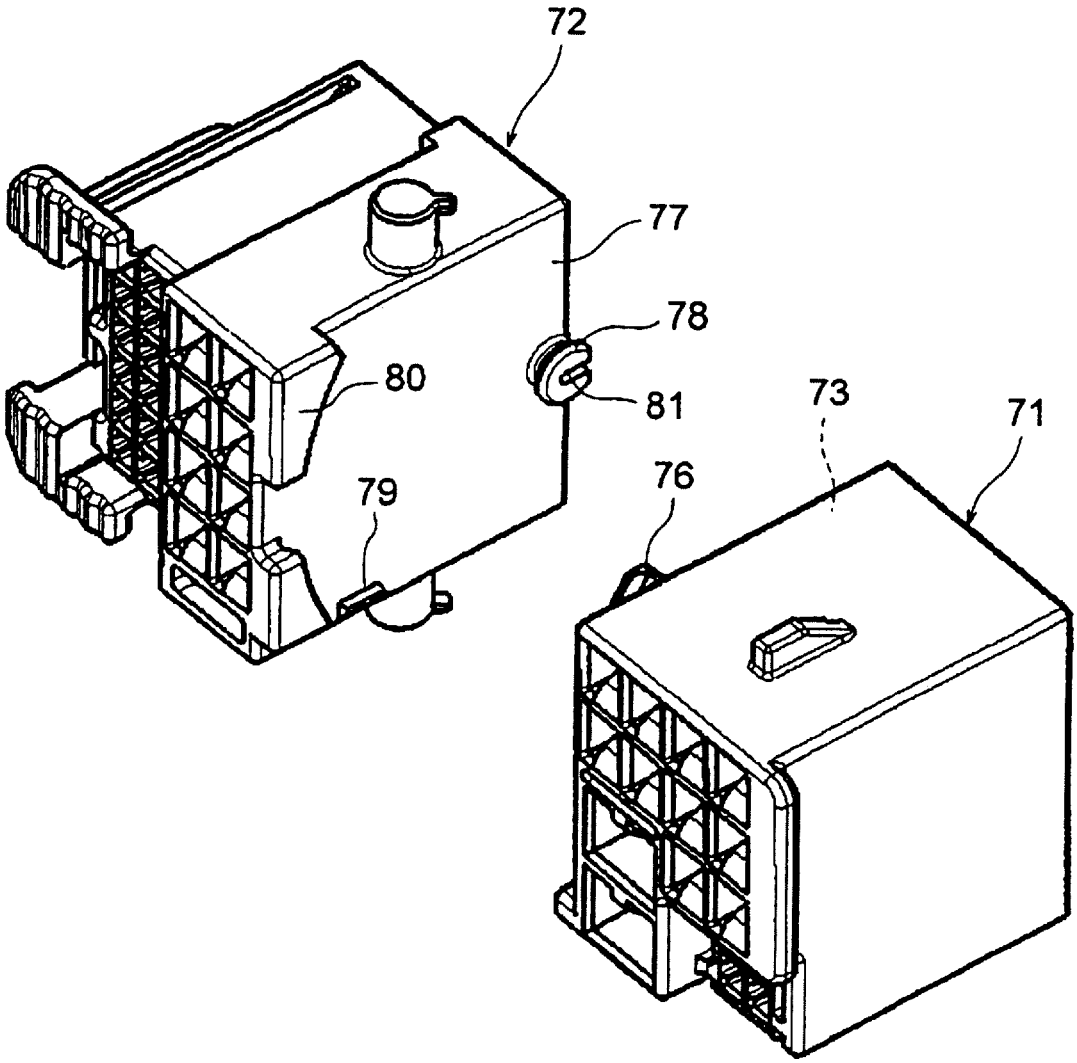
FIG. 10 is a perspective view relating to a second embodiment and illustrating a state in which the base connector and the detachable connector are separated from each other before the base connector and the detachable connector are connected to each other.
Figure 11:
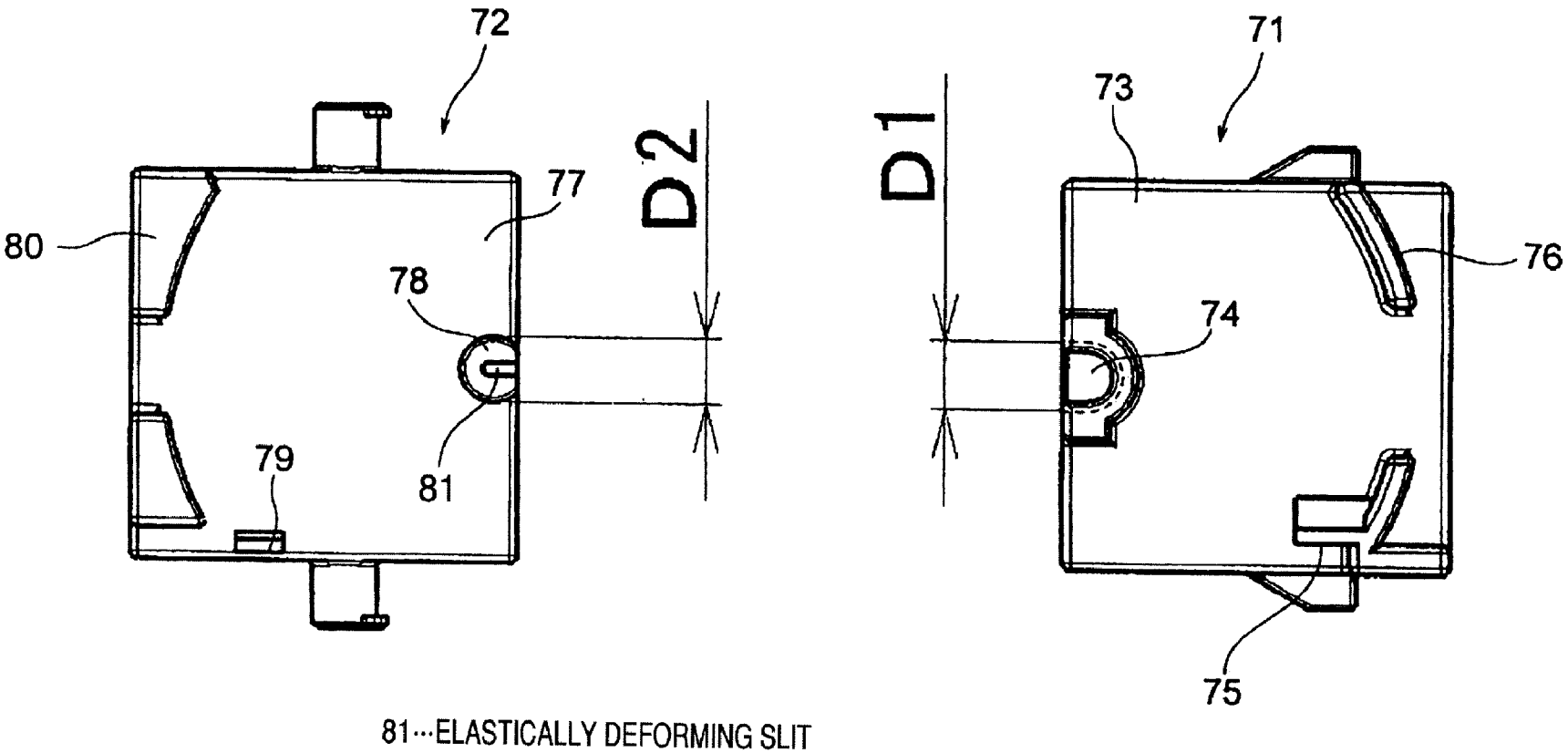
FIG. 11 is an explanatory view illustrating the dimensional relationship between a boss and a boss guide groove.

Next, a second embodiment of the invention is described hereinafter with reference to FIGS. 10 and 11. FIG. 10 is a perspective view illustrating a state in which a base connector and a detachable connector are separated from each other before connected to each other. Further, FIG. 11 is an explanatory view illustrating the dimensional relationship between a boss and a boss guide groove. Incidentally, fundamental functions of the second embodiment are the same as those of the first embodiment. Thus, the detailed description of the fundamental functions is omitted.

As illustrated in FIGS. 10 and 11, a combined-type connector includes a base connector 71 and a detachable connector 72 that can be connected to and disconnected from the base connector 71 by being rotated with respect to the base connector 71. A boss guide groove 74) a retaining groove 75, and a base-connector-side guide rail 76 are formed in a housing side portion 73 of the base connector 71. On the other hand, a boss 78 to be inserted into the boss guide groove 74, a retaining protrusion 79 which engages with the retaining groove 75, and a detachable-connector-side guide rail 80 which engages with the base-connector-side guide rail 76 are formed in a housing side portion 77 of the detachable connector 72.

The boss 78 and the boss guide groove 74 are set by being press-fit to absorb looseness at this portion. That is, the boss 78 and the boss guide groove 74 are formed so that the width D2 of the boss 78 is slightly larger (D1<D2) than the width D1 of an opening of the boss guide groove 74. Because the boss 78 and the boss guide groove 74 are set by being press-fit, an elastically deforming slit 81 is formed in the boss 78 in order to alleviate an insertion force to be applied to the boss guide groove 74 and the boss 78 at the formation of a combined-type connector by absorbing the insertion force into the slit 81.

Thus, according to the second embodiment, the boss 78 can be prevented by forming a press-fit state from being shaky in the boss guide groove 74. In addition, workability at the formation of a press-fit state can be taken into consideration. The second embodiment can contribute to the implementation of a normal contact between the terminal metal fittings and to the prevention of reduction of a contact margin.

Figure 12:
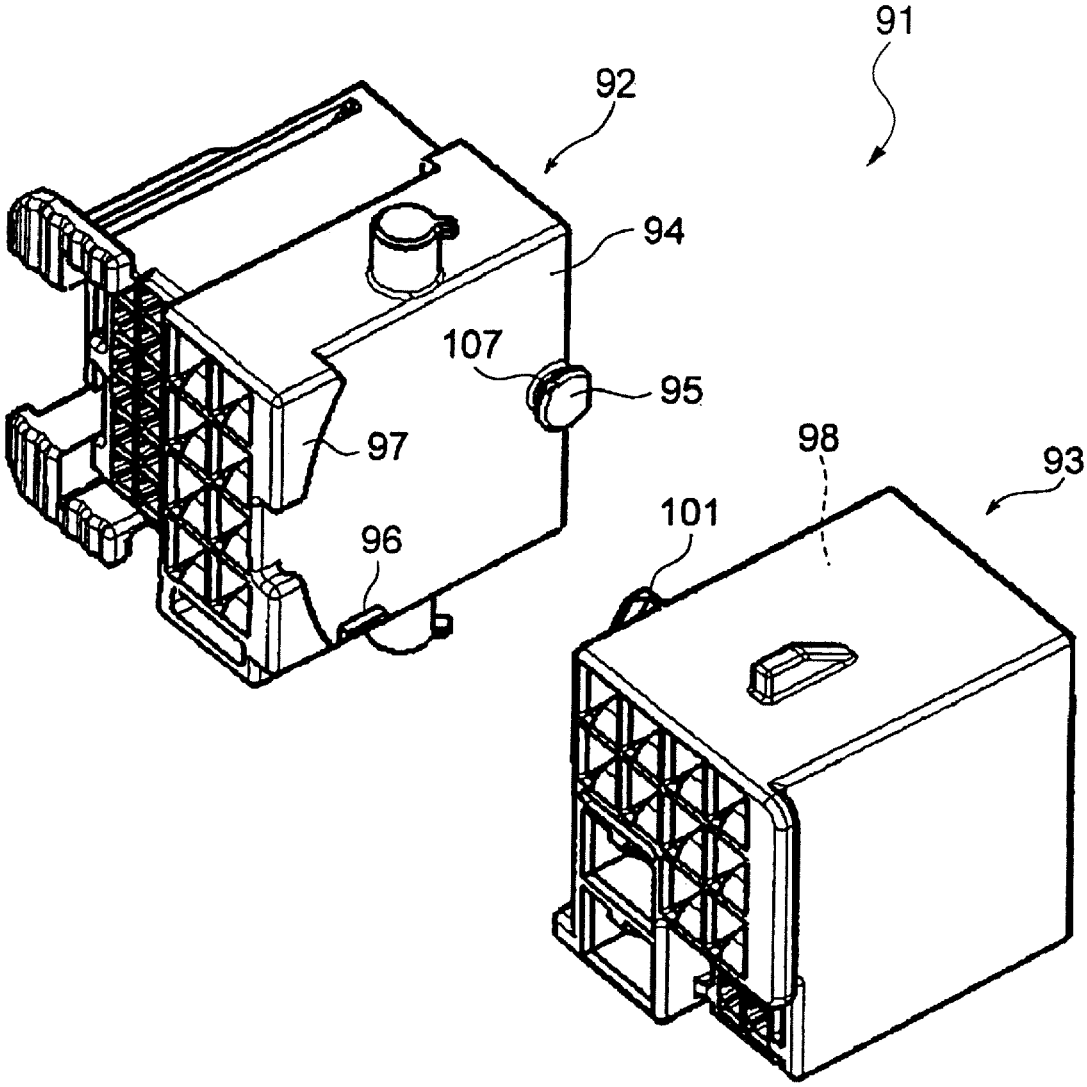
FIG. 12 is a perspective view relating to a third embodiment and illustrating a state in which the base connector and the detachable connector are separated from each other before the base connector and the detachable connector are connected to each other.
Figure 13:
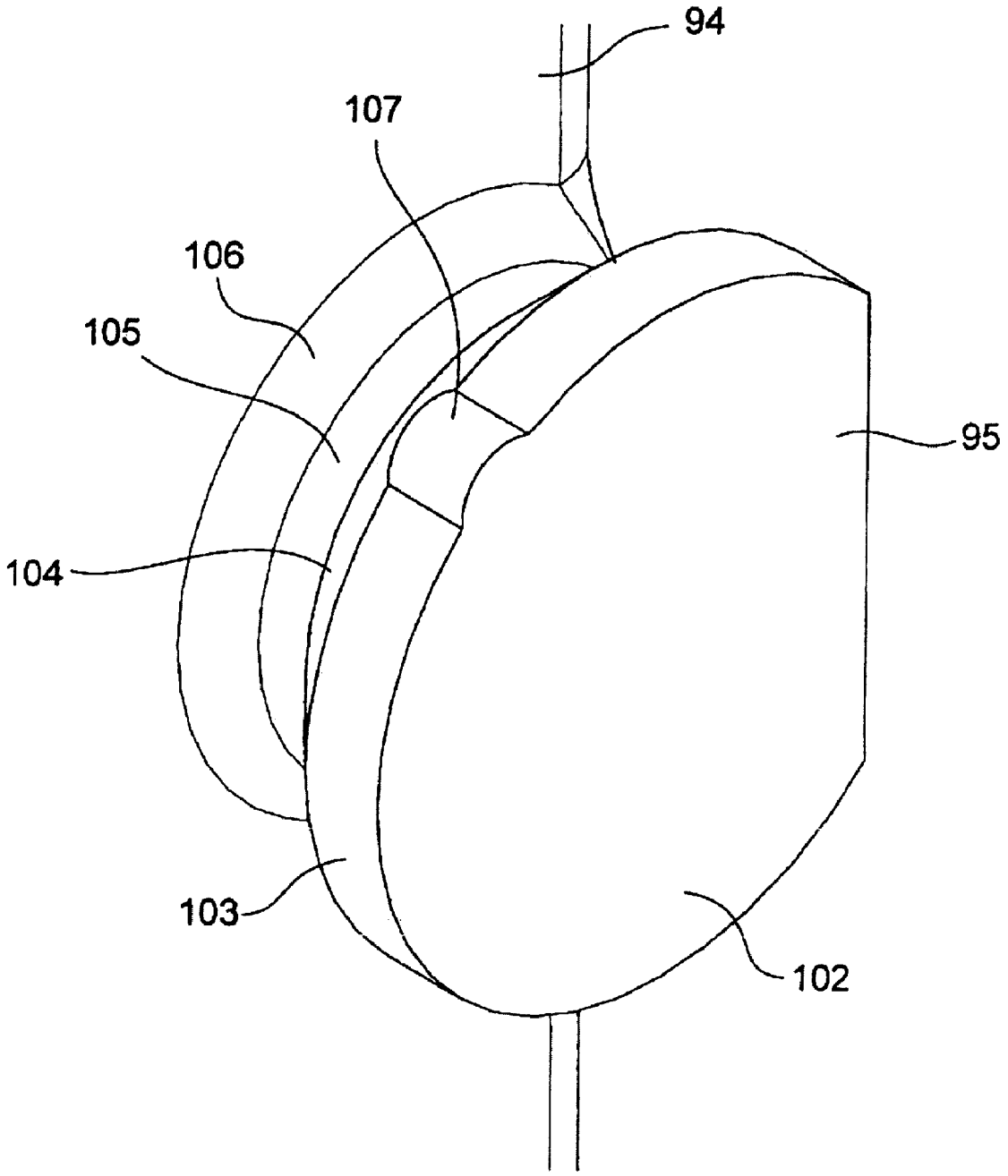
FIG. 13 is an enlarged perspective view illustrating a boss.
Figure 14:
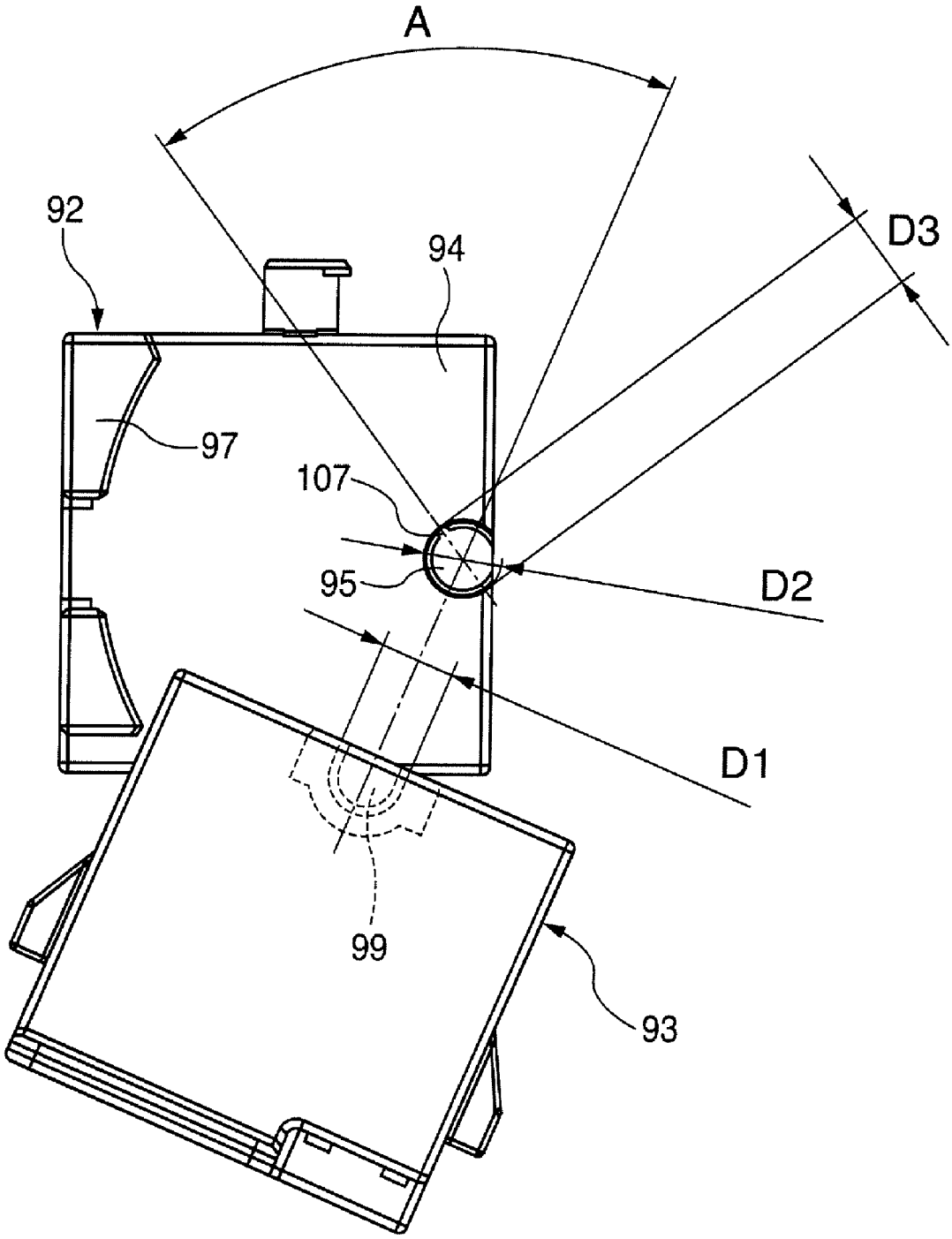
FIG. 14 is an explanatory view illustrating the dimensional relation between a boss and a boss guide.
Figure 15A:
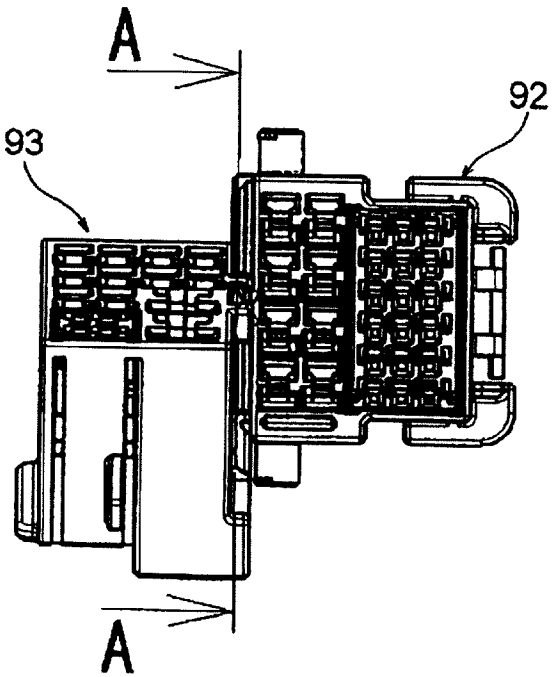
FIGS. 15A to 15C are views illustrating a state in which the boss guide groove is inserted onto the boss.
Figure 15B:
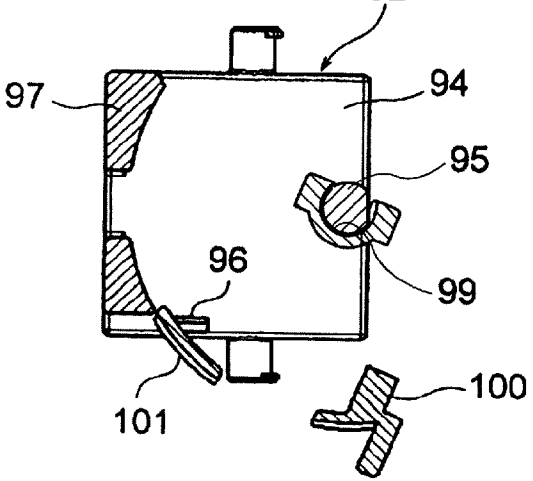
Figure 15C:
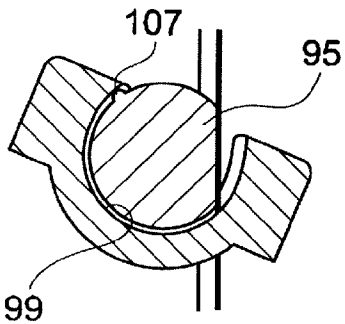
Figure 16A:
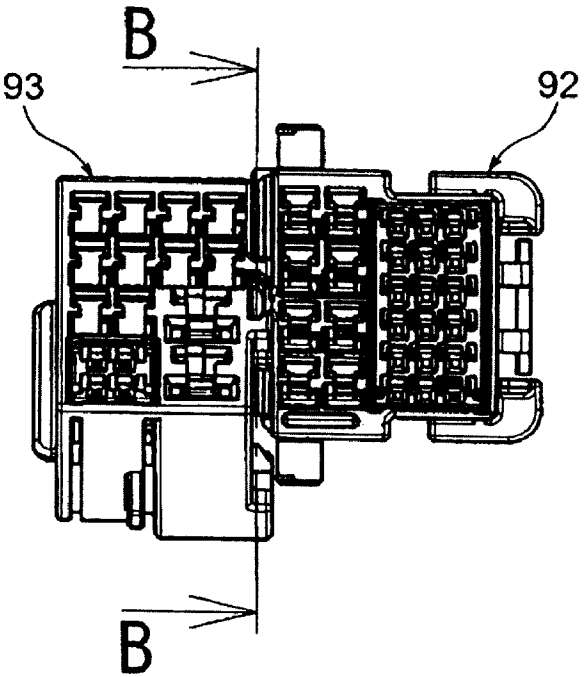
FIGS. 16A to 16C are views illustrating a state in process of rotating the detachable connector
Figure 16B:
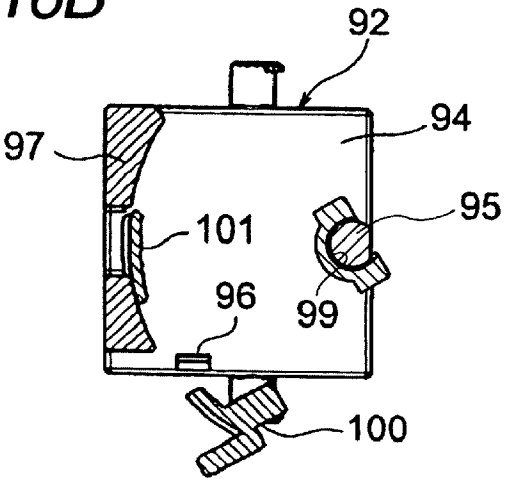
Figure 16C:
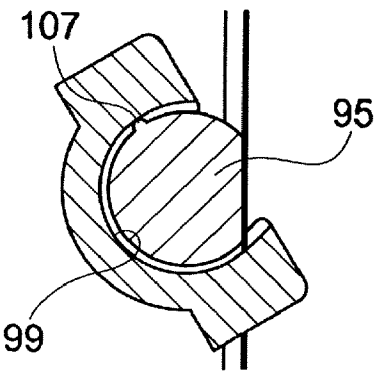
Figure 17A:
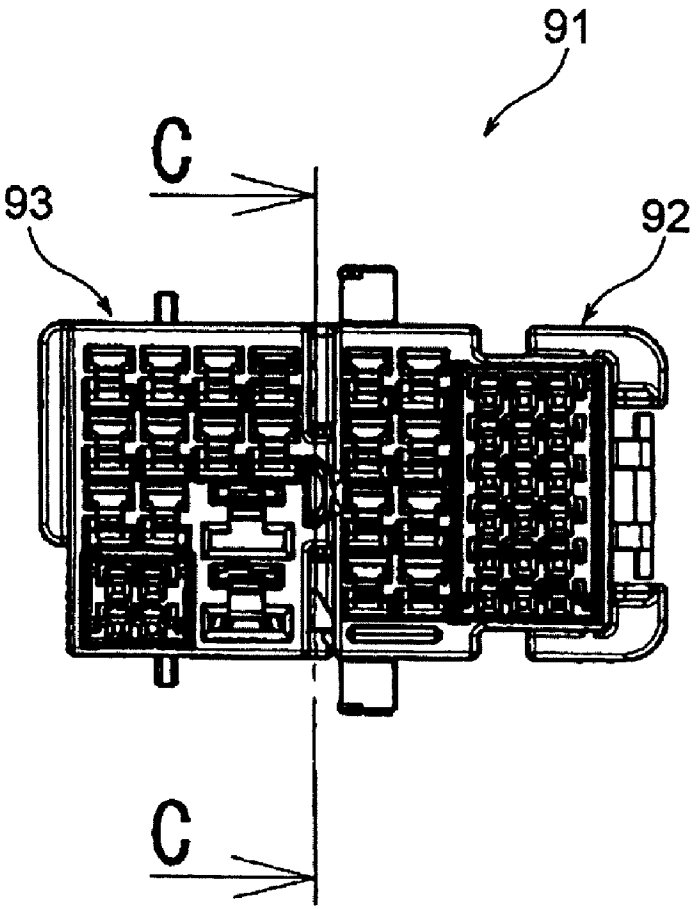
FIGS. 17A to 17B are views illustrating a state in which the base connector and the detachable connector are brought into a connected condition, so that a combined-type connector is formed.
Figure 17B:
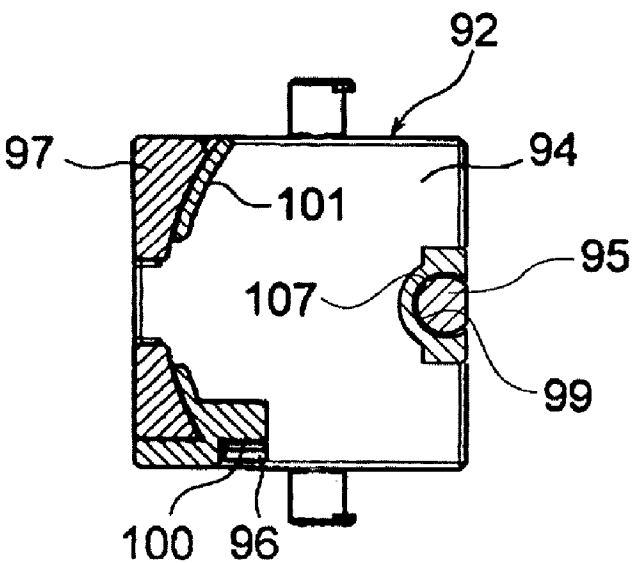

Next, a third embodiment of the invention is described hereinafter with reference to FIGS. 12 to 17B. FIG. 12 is a perspective view illustrating a state in which a base connector and a detachable connector are separated from each other before connected to each other. FIG. 13 is an enlarged perspective view illustrating a boss. FIG. 14 is an explanatory view illustrating the dimensional relation between the boss and a boss guide groove. FIGS. 15A to 15C are views illustrating a state in which the boss guide groove is inserted onto the boss. FIGS. 16A to 16C are views illustrating a state in process of rotating the detachable connector. FIGS. 17A to 17B are views illustrating a state in which the base connector and the detachable connector are brought into a connected state, so that a combined-type connector is formed. Incidentally, fundamental functions of the third embodiment are the same as those of the first embodiment. Thus, the detailed description of the fundamental functions is omitted.

As illustrated in FIG. 12, a combined-type connector 91 (see FIGS. 17A and 17B) includes a base connector 92, and a detachable connector 93 that can be connected to and disconnected from the base connector 92 by being rotated with respect to the base connector 92. A boss 95, a retaining protrusion 96, and a base-connector-side guide rail 97 are formed on a housing side portion 94 of the base connector 92. On the other hand, as illustrated in FIG. 15B, a boss guide groove 99 to be inserted into the boss 95, a retaining groove 100 to be engaged with the retaining protrusion 96, and a detachable-connector-side guide rail 101 to be engaged with the base-connector-side guide rail 97 are formed on a housing side portion 98 of the detachable connector 93.

As illustrated in FIG. 13, the boss 95 includes a boss top surface 102, a flange portion first curved side surface (flange portion side surface) 103 which is continuous with a circular-arc portion of the boss top surface 102, a flange portion second curved side surface (flange portion side surface) 104 which is continuous with the flange portion first curved side surface 103, a body portion curved side surface (body portion side surface) 105 which is continuous with the flange portion second curved side surface 104, and a base end portion 106 which is continuous with the body portion curved side surface 105. A press-fitting protrusion 107 is formed at a predetermined position on the flange portion first curved side surface 103 on such a boss 95.

As illustrated in FIG. 14, the boss 95 and the boss guide groove 99 are set by being press-fit to absorb looseness at this portion. That is, the boss 95 and the boss guide groove 99 are formed so that the width D3 of the boss 95 is slightly larger than the width D1 of an opening of the boss guide groove 99 (D1<D3) and than the normal width D2 of the boss 95 by an additional amount due to the presence of the press-fitting protrusion 107. Because the boss 95 and the boss guide groove 99 are set by being press-fit, the boss guide groove 99 is inserted onto the boss 95 from a position, which is displaced from the position of the press-fitting protrusion 107 of the boss 95 by an amount corresponding to an angle A, (the position, from which the boss guide groove 99 is inserted, is a mere example) in order to alleviate an inserting force to be applied to each of the boss guide groove 99 and the boss 95 at the formation of the combined-type connector 91 (see FIG. 17). FIGS. 15A to 15C are views each illustrating a state in which the boss guide groove 99 is inserted onto the boss 95. At that time, the boss 95 and the boss guide groove 99 are not brought into a press-fit state. Thus, the boss guide groove 99 can smoothly be inserted onto the boss 95 (alternatively, an operation of inserting the boss 95 into the boss guide groove 99 can be performed).

When the detachable connector 93 can be rotated in the connecting direction with respect to the base connector 92, a press-fit state is formed between the press-fitting protrusion 107 and the boss guide groove 99 in process of this rotation of the detachable connector 93 as illustrated in FIG. 16. Consequently, the looseness between the boss 95 and the boss guide groove 99 is absorbed. When the base connector 92 and the detachable connector 93 are completely connected to each other, as illustrated in FIG. 17, in a state in which the looseness is absorbed, the combined-type connector 91 is formed.

Thus, according to the third embodiment, the boss 95 can be prevented by forming a press-fit state from being shaky in the boss guide groove 99 (more specifically, the boss 95 can be prevented by the press-fitting protrusion 107 from being shaky in a direction perpendicular to the fitting direction in which the combined-type connector is fit to the mating connector). In addition, workability at the formation of a press-fit state can be taken into consideration. The third embodiment can contribute to the implementation of a normal contact between the terminal metal fittings and the prevention of reduction of a contact margin.

Figure 18:
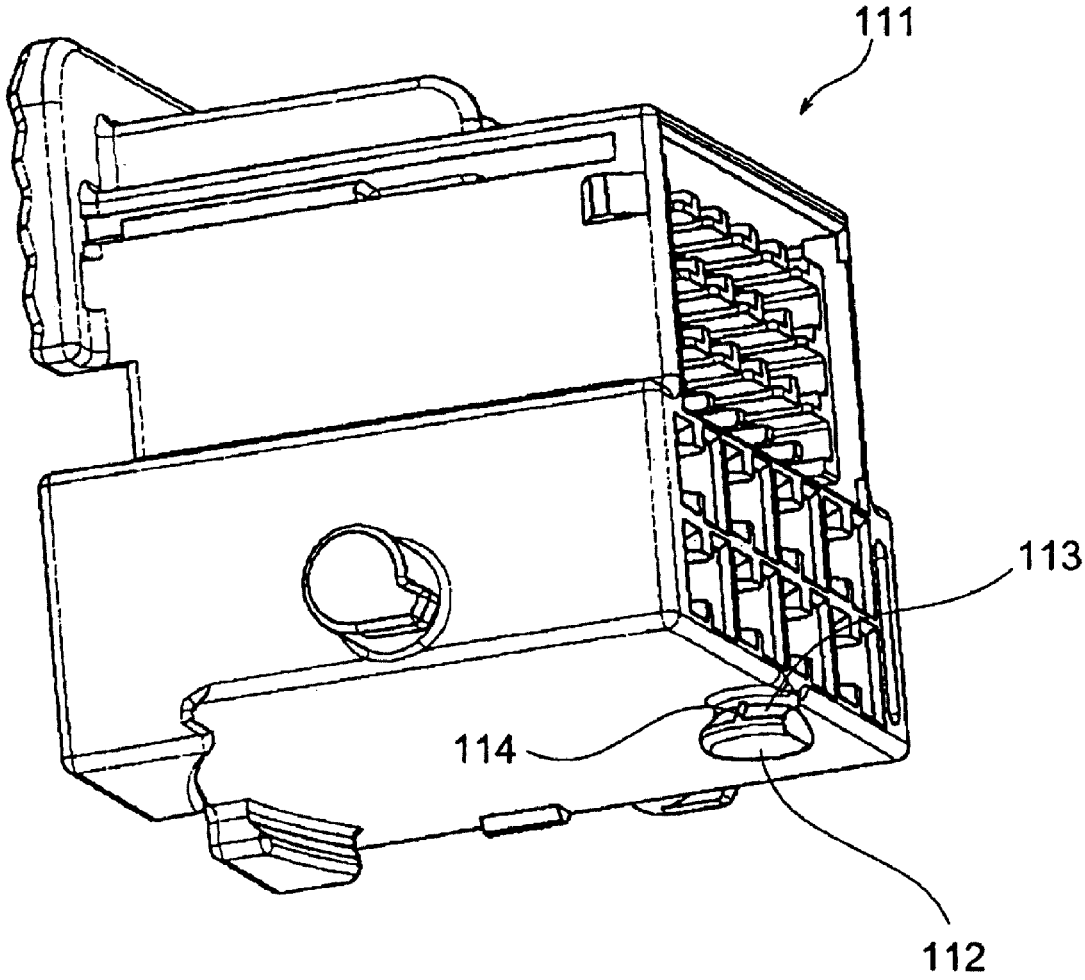
FIG. 18 is a perspective view relating to a fourth embodiment and illustrating a base connector having a boss
Figure 19:
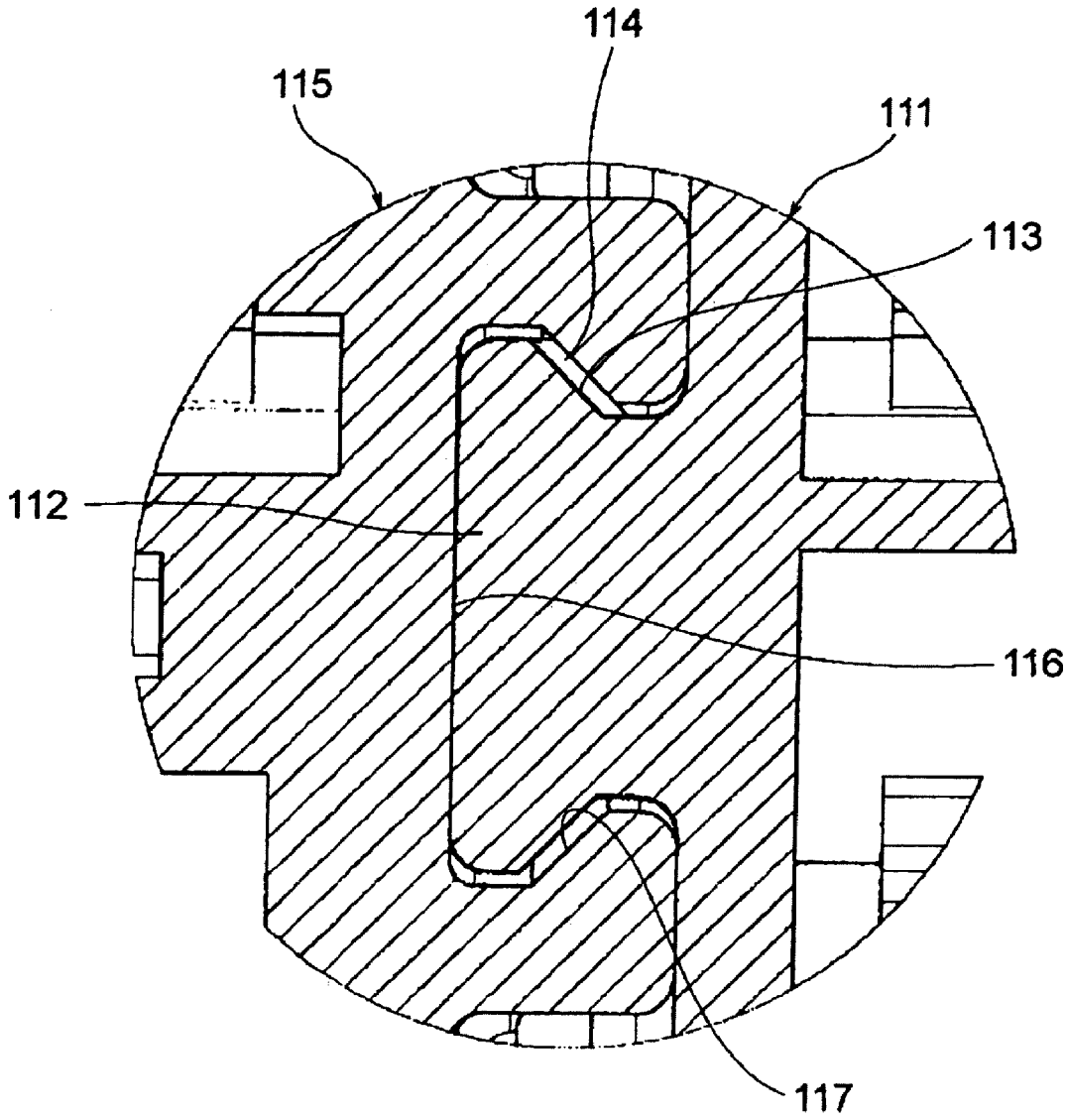
FIG. 19 is an enlarged cross-sectional view illustrating a boss and a boss guide groove.

Next, a fourth embodiment of the invention is described hereinafter with reference to FIGS. 18 to 19. FIG. 18 is a perspective view relating to the fourth embodiment and illustrating a base connector 111 having a boss 114. FIG. 19 is an enlarged cross-sectional view illustrating a boss 114 and a boss guide groove 116. Incidentally, the fourth embodiment is a modification of the aforementioned third embodiment.

As illustrated in FIGS. 18 and 19, a press-fitting protrusion 114 is formed at a predetermined position on a flange portion second curved side surface (flange portion side surface) 113 of a boss 112 provided on the base connector 111 to protrude therefrom. The press-fitting protrusion 114 is such that a press-fit state can be formed between the press-fitting protrusion 114 and a guide groove second side surface (guide groove side surface) 117 formed on the boss guide groove 116 of the detachable connector 115, as illustrated in FIG. 19 (in the present embodiment, the press-fitting protrusion 114 is formed at the same position as that at which the press-fitting protrusion 107 of the third embodiment is formed).

Thus, according to the fourth embodiment, the boss 112 can be prevented by forming a press-fit state from being shaky in the boss guide groove 116 (more specifically, the boss 112 can be prevented by the press-fitting protrusion 117 from being shaky in the direction in which the base connector 111 and the detachable connector 115 are aligned with each other). In addition, workability at the formation of a press-fit state can be taken into consideration. The fourth embodiment can contribute to the implementation of a normal contact between the terminal metal fittings and to the prevention of reduction of a contact margin.

Incidentally, the press-fitting protrusion 117 can be arranged and formed on the boss top surface, instead of the flange portion second curved side surface 113 of the boss 112. In this case, a press-fit state is formed between the boss 112 and the boss guide groove 116. Thus, advantages similar to the aforementioned advantages can be achieved.

In addition, although the shapes of the flange portion second curved side surface 113 and the guide groove second side surface 117 are not limited to specific shapes, the shapes thereof are not necessarily that of the cross-sectionally taperedly inclined surface as illustrated in FIG. 19. For example, a hook-like shape, in which surfaces parallel to the boss top surface are opposed to each other, can be formed as the shapes of the flange portion second curved side surface 113 and the guide groove second side surface 117. Alternatively, these surfaces can be shaped like a cross-sectionally circular-arc-like inclined one.

Figure 20B:
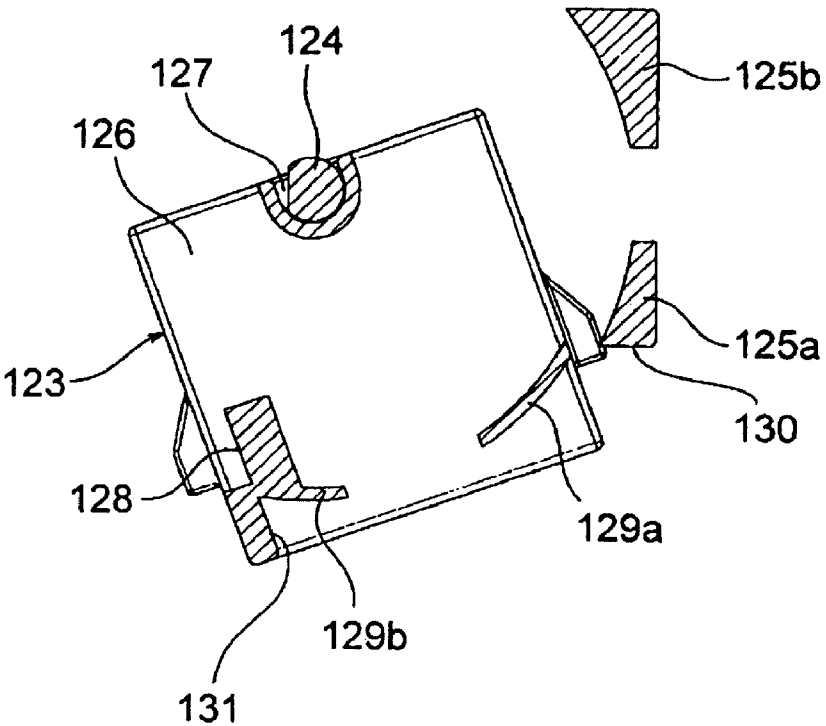
FIGS. 20A and 20B are views relating to a fifth embodiment and illustrating a state immediately after the start of rotating a detachable connector with respect to a base connector.
Figure 20A:
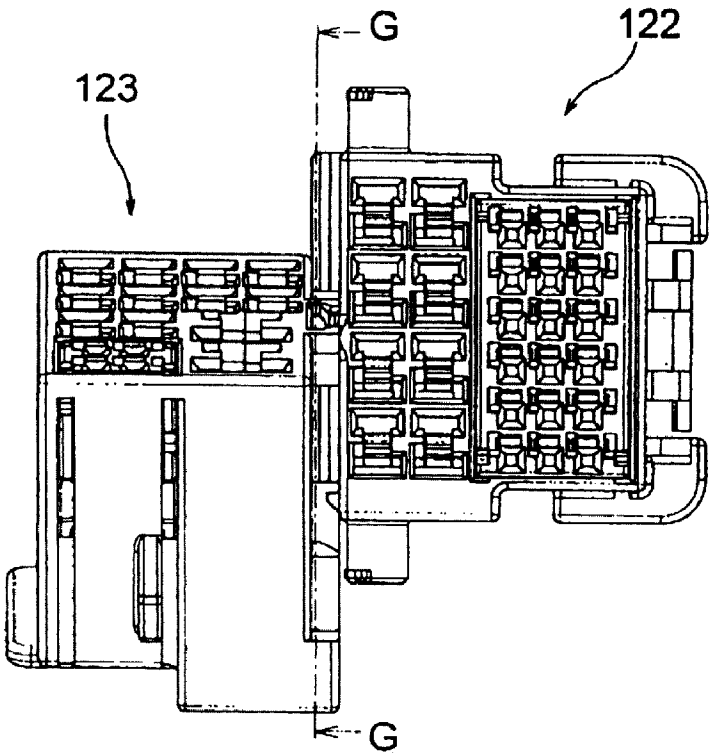
Figure 21B:
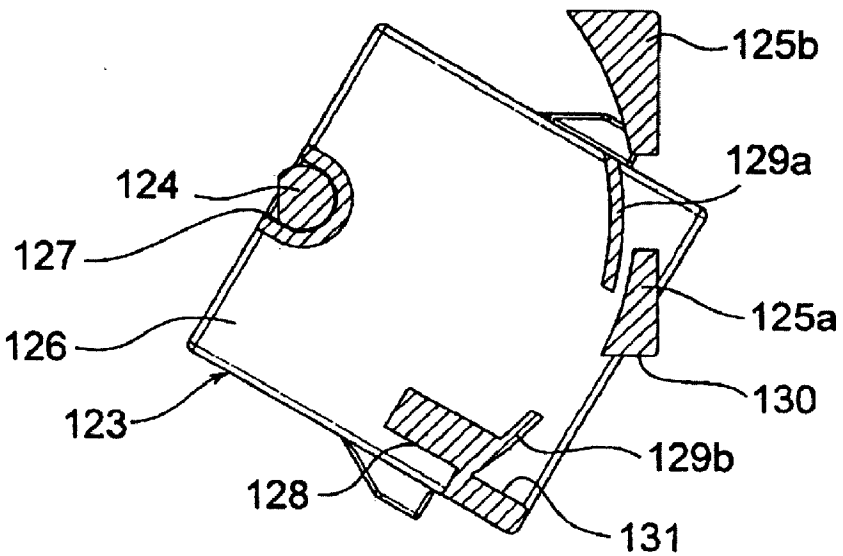
FIGS. 21A and 21B are views illustrating a state in process of rotating the detachable connector with respect to the base connector.
Figure 21A:
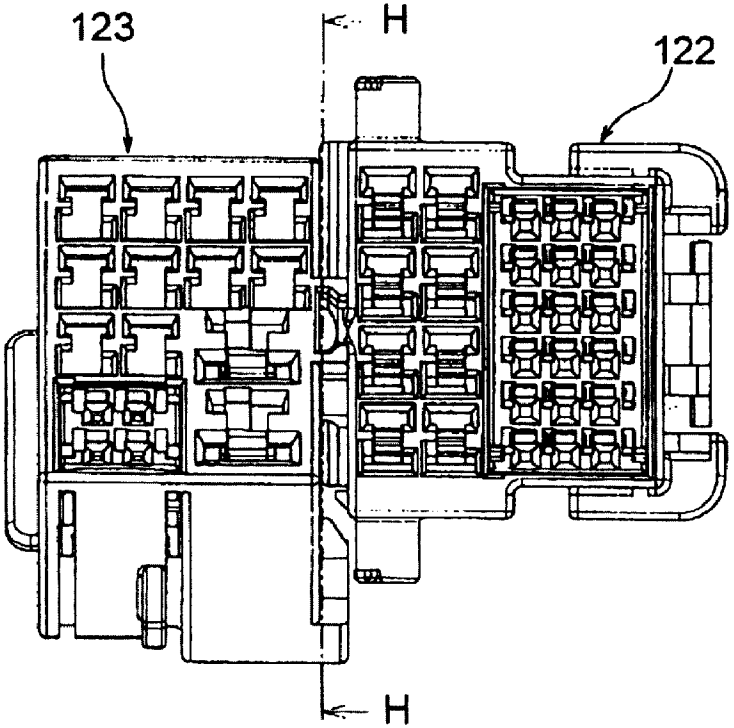
Figure 22B:
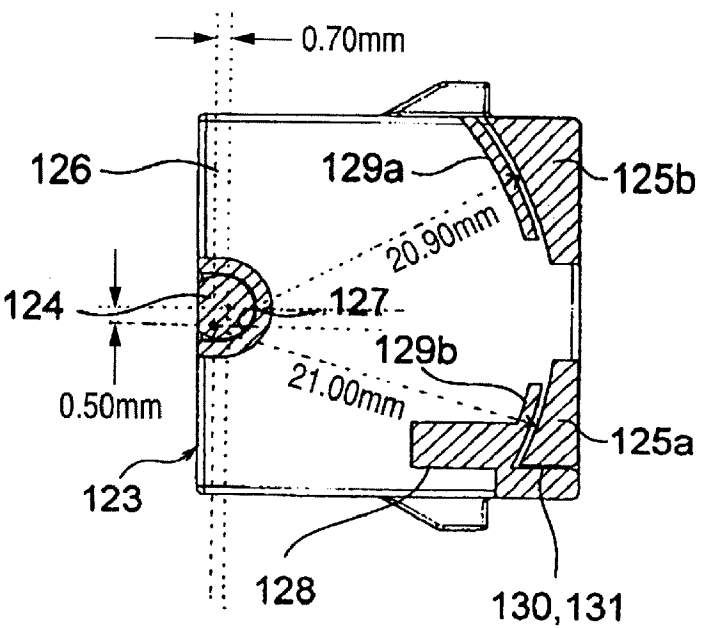
FIGS. 22A and 22B are views each illustrating a state in which the base connector and the detachable are aligned with and connected to each other.
Figure 22A:
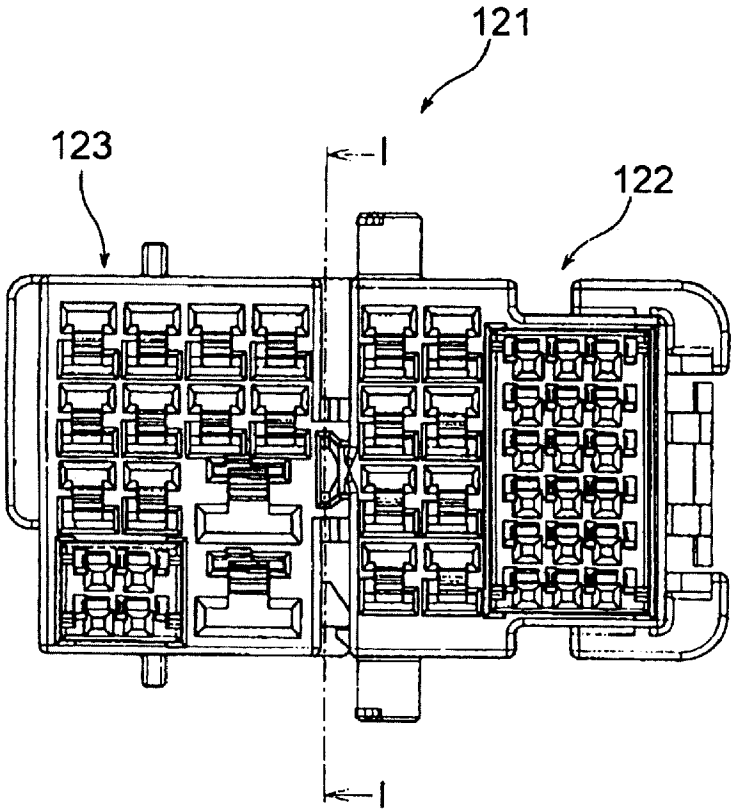

Next, a fifth embodiment of the invention is described hereinafter with reference to FIGS. 20A to 22B. FIGS. 20A and 20B are views illustrating a state immediately after the start of rotating a detachable connector with respect to a base connector. FIGS. 21A and 21B are views illustrating a state in process of rotating the detachable connector with respect to the base connector. FIGS. 22A and 22B are views each illustrating a state in which the base connector and the detachable are aligned with and connected to each other.

As illustrated in FIGS. 20A and 20B, a combined-type connector 121 (see FIG. 22) is configured to include a base connector 122, and a detachable connector 123 that can be connected to and disconnected from the base connector 122 by being rotated with respect to the base connector 122. A boss 124, a retaining groove, and base-connector-side guide rails 125*a* and 125*b* are formed in a housing side portion of the base connector 122. On the other hand, a boss guide groove 127 to be inserted onto the boss 124, a retaining groove 128 which engages with the retaining protrusion 75, and detachable-connector-side guide rails 129*a* and 129*b* which engage with the base-connector-side guide rails 125*a* and 125*b* are formed in a housing side portion 126 of the detachable connector 123. Stopper faces 130 and 131 are formed on the base-connector-side guide rail 125*a* and the detachable-connector-side guide rail 129*b*, respectively.

As illustrated in FIGS. 20A to 21, the base connector 122 and the detachable connector 123 are such that a sufficient clearance between the base-connector-side guide rail 125*a* and the detachable-connector-side guide rail 129*a* is provided in process of the rotation of the detachable connector 123, so that workability can be improved. In a case where a connected sate between the base connector 122 and the detachable connector 123 is subsequently formed, the clearance between the base-connector-side guide rail 125*b* and the detachable-connector-side guide rail 129*a* and that between the base-connector-side guide rail 125*a* and the detachable-connector-side guide rail 129*b* are reduced, as illustrated in FIG. 22. Consequently, the looseness between the guide rails is absorbed.

Thus, the fifth embodiment can achieve clearance adjustment. Further, the fifth embodiment can absorb the looseness between the guide rails. In addition, the workability can be taken into consideration. The fifth embodiment can contribute to the implementation of a normal contact between the terminal metal fittings and the prevention of reduction of a contact margin.

Incidentally, a supplementary explanation is made hereinafter by referring to FIGS. 22A and 22B. A position obtained by displacing the center of the boss 124 by 0.70 mm downwardly from paper, on which FIGS. 22A and 22B are drawn, and further rightwardly displacing the position of the displaced center of the boss 124 by 0.50 mm is each of the center position between the base-connector-side guide rails 125*a* and 125*b* and that between the detachable-connector-side guide rails 129*a* and 129*b*. A radius R connecting this center position to the engagement position between the base-connector-side guide rail 125*b* and the detachable-connector-side guide rail 129*a* is 20.90 mm. A radius R connecting this center position to the engagement position between the base-connector-side guide rail 125*a* and the detachable-connector-side guide rail 129*b* is 21.00 mm.

Figure 23:
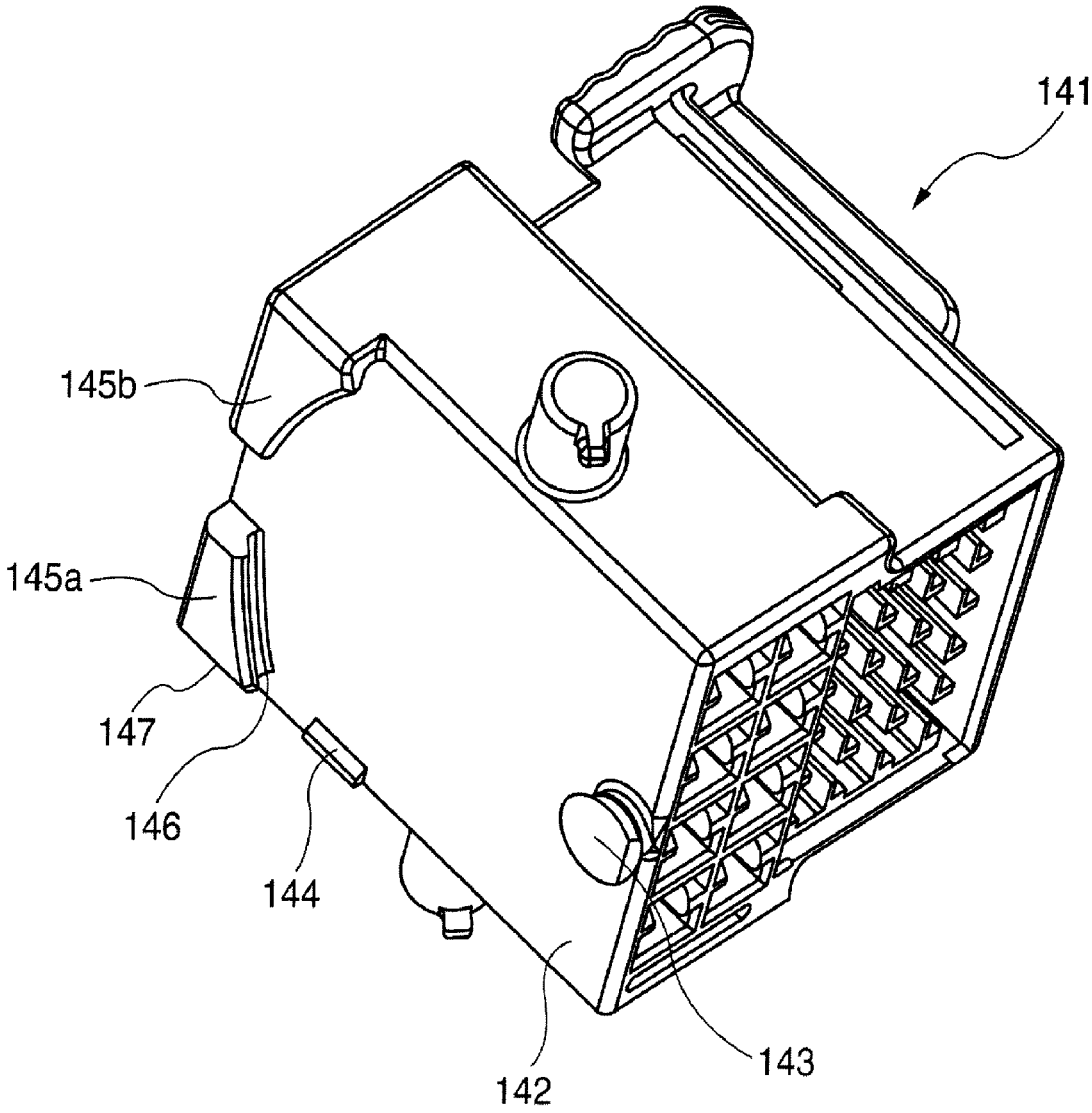
FIG. 23 is a perspective view relating to a sixth embodiment and illustrating a first type of a base connector.
Figure 24:
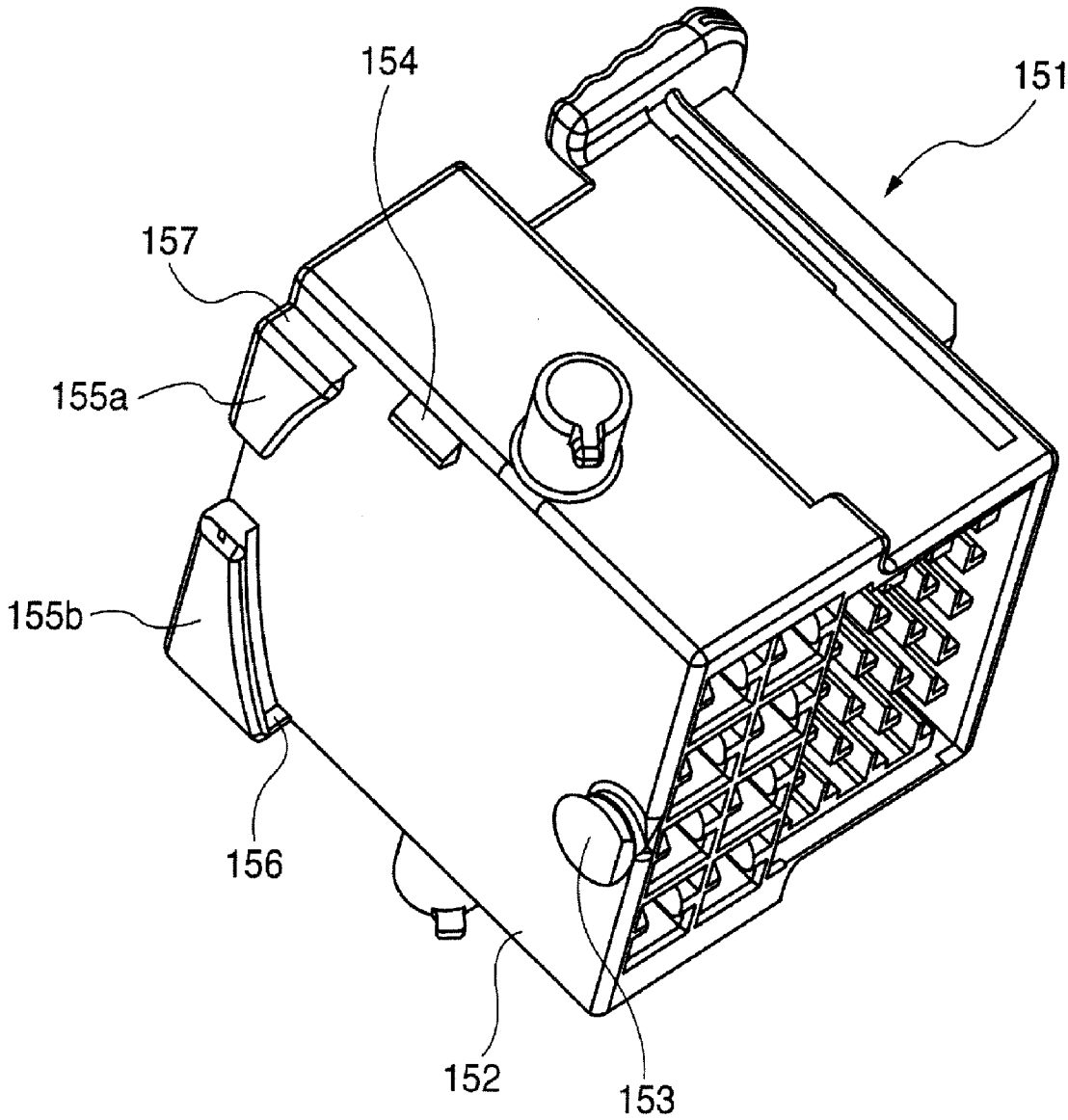
FIG. 24 is a perspective view illustrating a second type of a base connector having an erroneous connection preventing portion.
Figure 25:
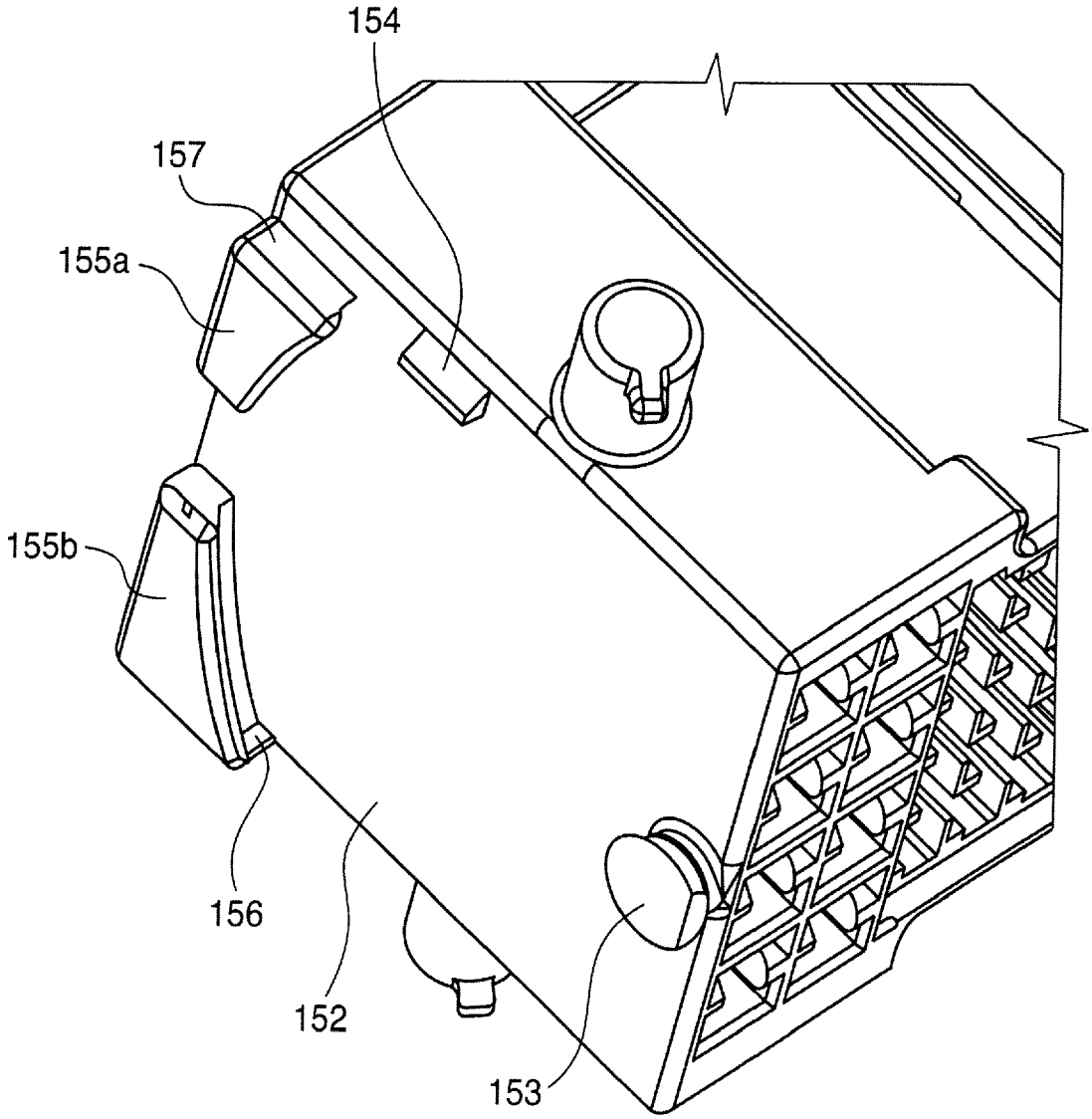
FIG. 25 is an enlarged perspective view illustrating the erroneous connection preventing portion.
Figure 26:
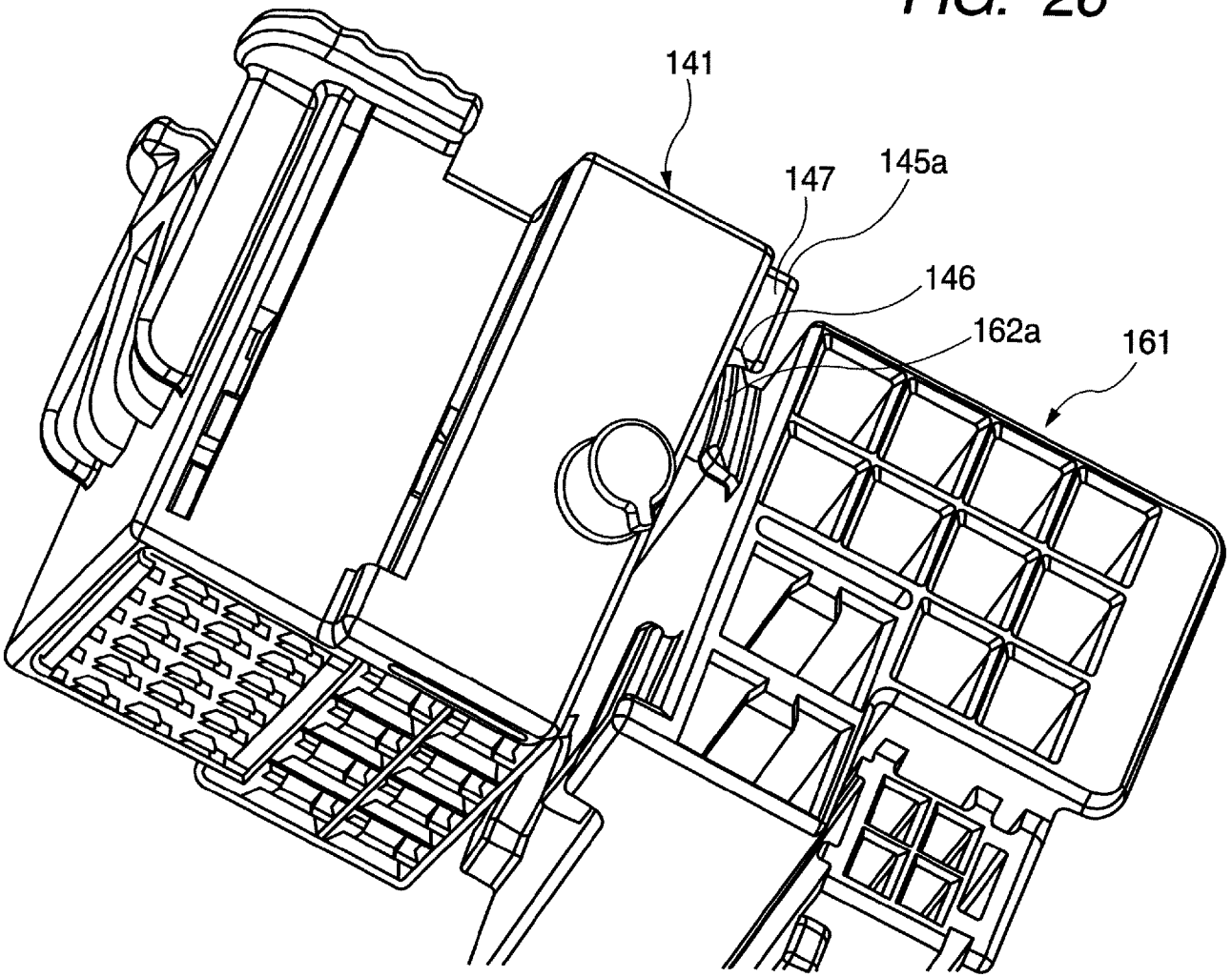
FIG. 26 is a perspective view illustrating a state in which the rotation of a detachable connector in a connecting direction with respect to the first type of the base connector is performed.
Figure 27:
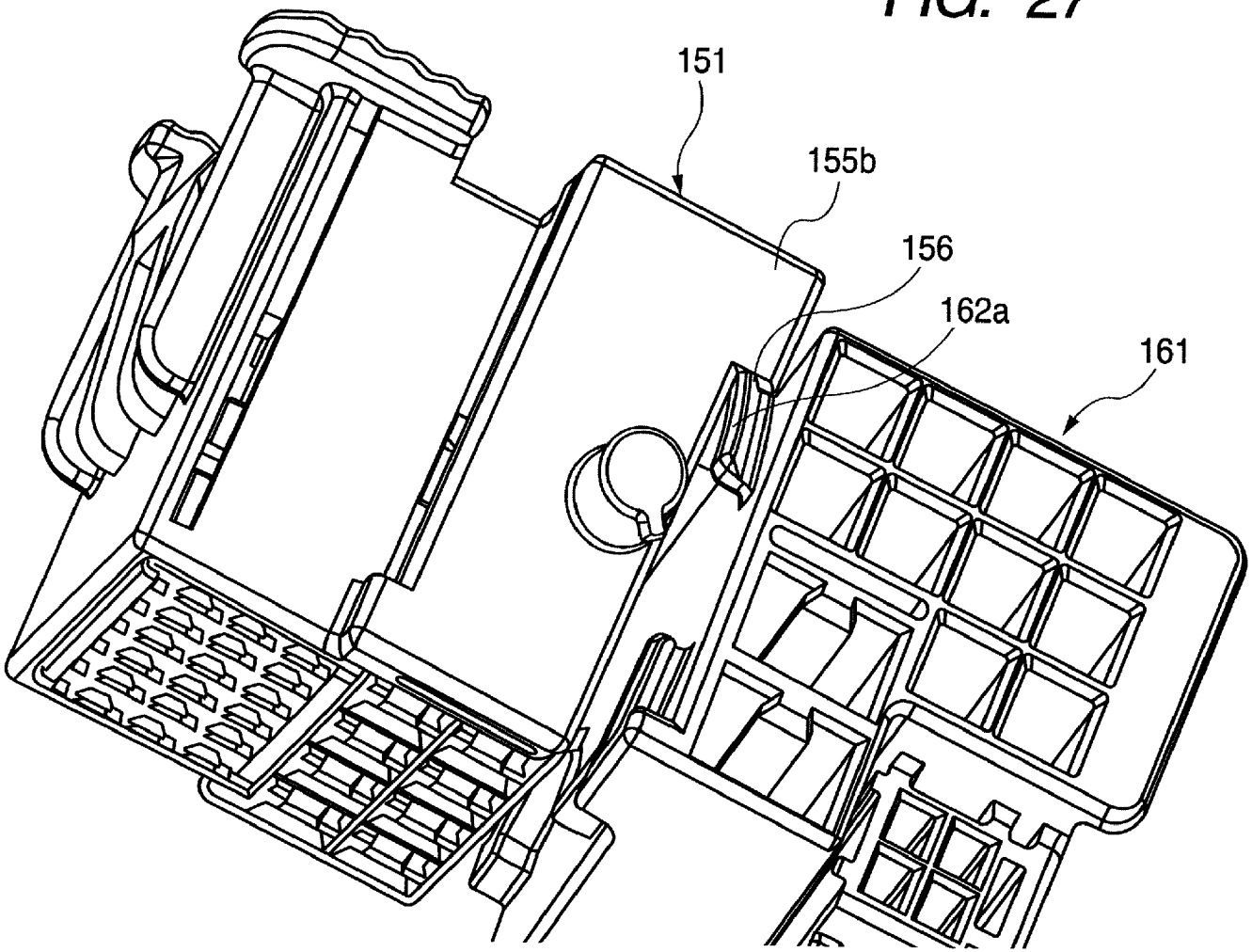
FIG. 27 is a perspective view illustrating a state in which the rotation of a detachable connector in a connecting direction with respect to the first type of the base connector is disabled.

Finally, a sixth embodiment of the invention is described hereinafter with reference to FIGS. 23 to 27. FIG. 23 is a perspective view relating to the sixth embodiment and illustrating a first type of a base connector. FIG. 24 is a perspective view illustrating a second type of a base connector having an erroneous connection preventing portion 156. FIG. 25 is an enlarged perspective view illustrating the erroneous connection preventing portion 156. FIG. 26 is a perspective view illustrating a state in which the rotation of a detachable connector in a connecting direction with respect to the first type of the base connector is performed. FIG. 27 is a perspective view illustrating a state in which the rotation of a detachable connector in a connecting direction with respect to the first type of the base connector is impossible.

As illustrated in FIG. 23, a boss 143, a retaining protrusion 144, and base-connector-side guide rails 145*a* and 145*b* are formed in a housing side portion 142 of a first type of a base connector 141. An inserting/removing opening portion 146 for a detachable-connector-side guide rail to be described below is formed on the base-connector-side guide rail 145*a*. Further, a stopper face 147 is also formed on the base-connector-side guide rail 145*a*. A retaining protrusion 144 is arranged and formed in the vicinity of the stopper face 147.

As illustrated in FIG. 24, a boss 153, a retaining protrusion 154, and base-connector-side guide rails 155*a* and 155*b* are formed on a housing side portion 152 of a second type base connector 151. An erroneous connection preventing portion 156, on which detachable-connector-side guide rail to be described below abuts, thereby to be enabled to restrain the rotation of the detachable connector in the connecting direction, is formed on the base-connector-side guide rail 155*b*. Further, a stopper face 157 is formed on the base-connector-side guide rail 155*a*. A retaining protrusion 154 is arranged and formed in the vicinity of the stopper face 157. The erroneous connection preventing portion 156 is formed like a wall that blocks an end portion of the groove-like base-connector-side guide rail 155*a*, as illustrated in FIGS. 24 and 25.

When a detachable connector 161 is rotated in the connecting direction with respect to the first type base connector 141 in order to form a combined-type connector, a detachable-connector-side guide rail 162*a* of the detachable connector 161 is inserted thereinto via an opening portion 146 of the base-connector-side guide rail 145*a* as illustrated in FIG. 26. Consequently, engagement therebetween is caused. Subsequently, a combined-type connector is formed. On the other hand, in the case of using a second type of a base connector 1511 as illustrated in FIG. 27, the detachable-connector-side guide rail 162*a* of the detachable connector 161 abuts against the erroneous connection preventing portion 156. Accordingly, the rotation of the detachable connector in the connecting direction is made impossible. That is, occurrence of an erroneous connection between different types of connectors can be prevented by forming the erroneous connection preventing portion 156. Moreover, occurrence of a non-normal rotation of a detachable connector can be restrained by the erroneous connection preventing portion 156.

Figure 28A:
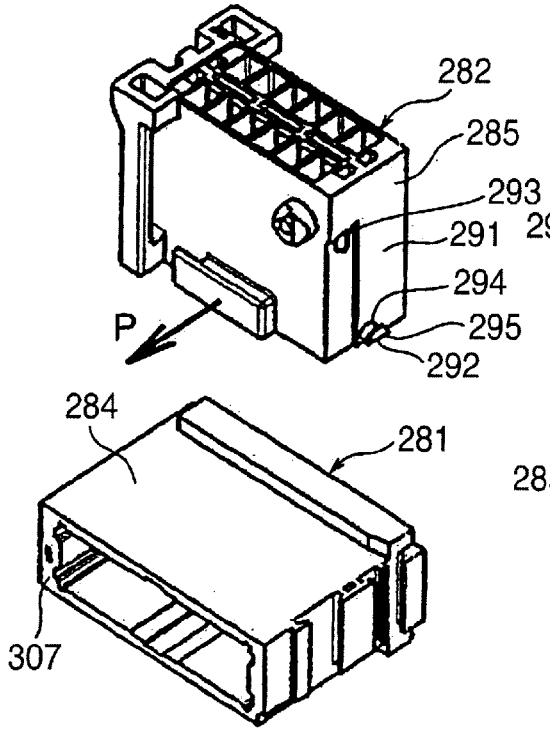
FIGS. 28A to 28C are perspective views each illustrating an embodiment (i.e., a sixth embodiment) of a combined-type connector of the invention.
Figure 28B:
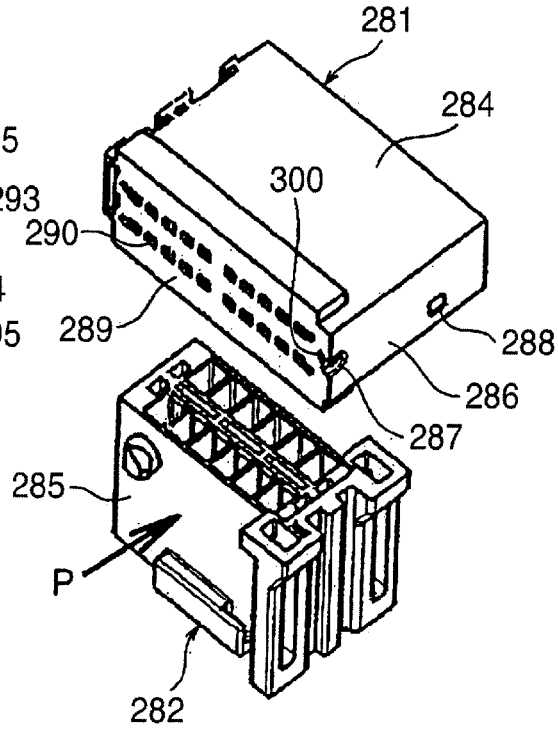
Figure 28C:
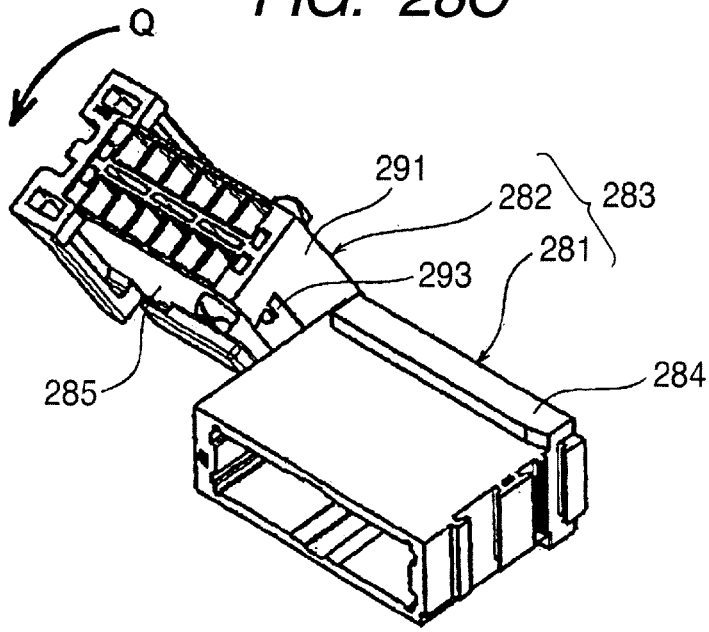
Figure 29A:
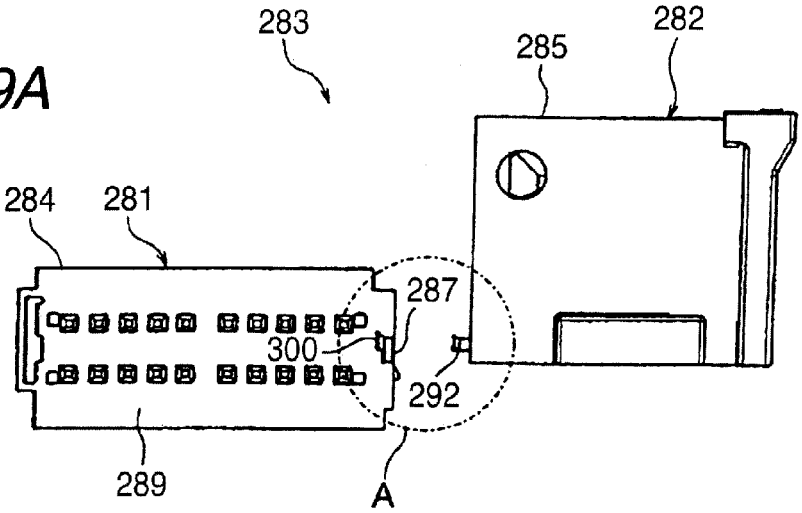
FIGS. 29A to 29C are views each illustrating a state before the base connector and the detachable connector are connected to each other
Figure 29B:
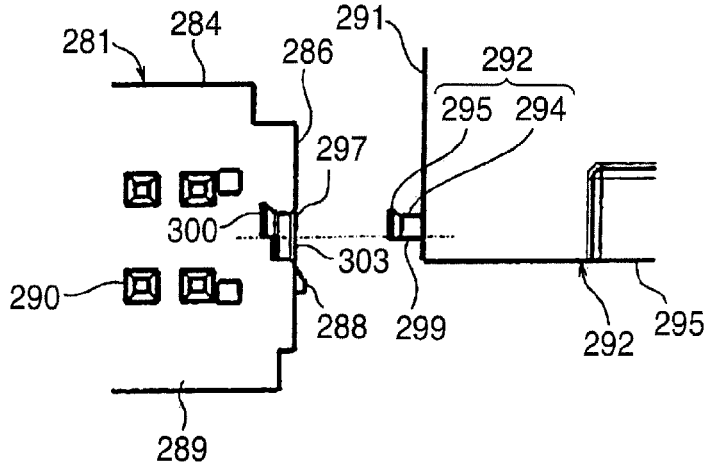
Figure 29C:
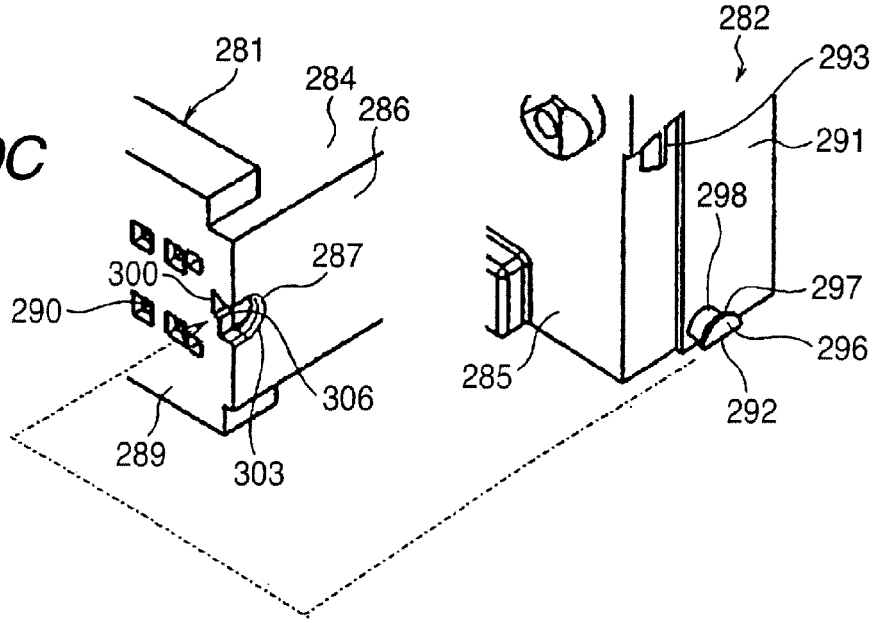
Figure 30A:
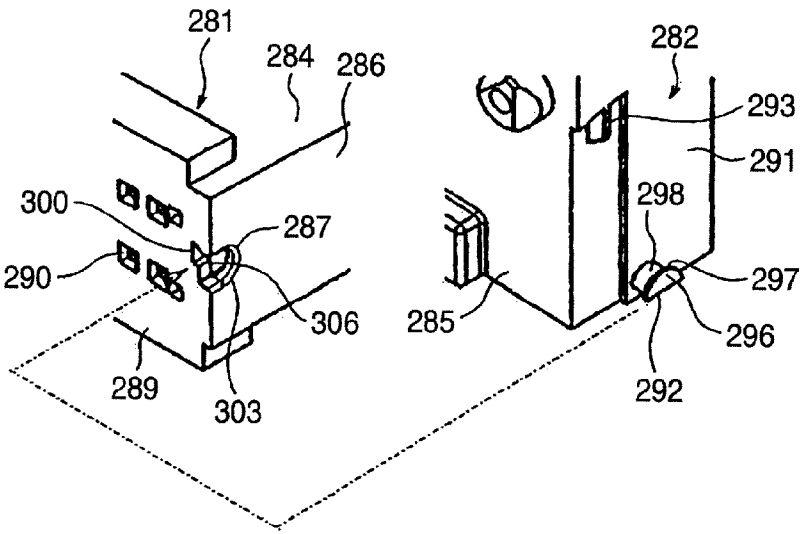
FIGS. 30A to 30D are explanatory views each concerning the boss and the boss guide groove.
Figure 30B:
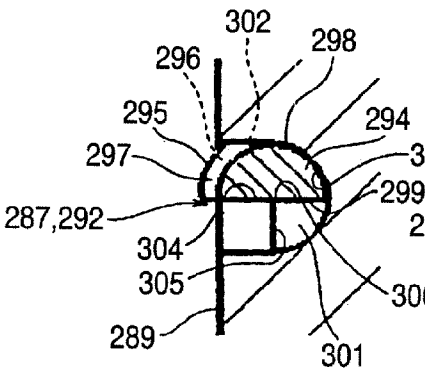
Figure 30C:
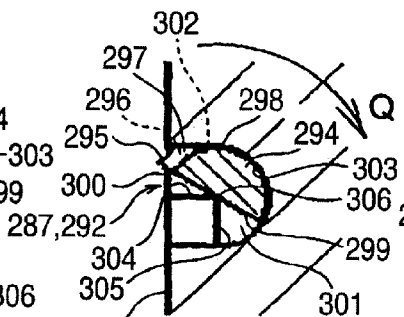
Figure 30D:
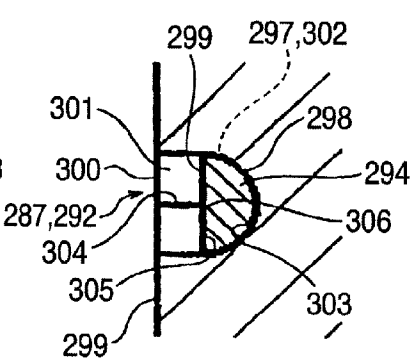

The seventh embodiment of the invention is described by referring to the accompanying drawings. FIGS. 28A to 28C are perspective views each illustrating an embodiment of a combined-type connector of the invention. FIGS. 28A and 28B are perspective views each illustrating a state before a base connector and a detachable connector are connected to each other FIG. 28C is a perspective view illustrating a state in process of rotating the detachable connector. FIGS. 29A to 29C are views each illustrating a state before the base connector and the detachable connector are connected to each other. FIG. 29A is a plan view illustrating a state before the base connector and the detachable connector are connected to each other. FIG. 29B is an enlarged view illustrating a part A shown in FIG. 29A. FIG. 29C is a perspective view illustrating a boss and a boss guide groove in the state before the base connector and the detachable connector are connected to each other FIGS. 30A to 30D are explanatory views each concerning the boss and the boss guide groove. FIG. 30A is a front view illustrating a state of the boss and the boss guide groove before the boss and the boss guide groove are connected to each other. FIG. 30B is a cross-sectional view illustrating a state in which the boss is inserted into the boss guide groove. FIG. 30C is a cross-sectional view illustrating a state in process of rotating the boss. FIG. 30D is a cross-sectional view illustrating a state in which the rotation of the boss is finished. Further, FIGS. 31A to 33B are explanatory views concerning a connecting process.

The boss 292 includes a boss body portion 294 and a flange portion 295 that is continuous with one end side of the boss body portion 34. The boss 32 is formed into a shape having a semicircular cross-section taken in a direction perpendicular to a boss protruding direction in which the boss 292 is protruded. The boss 292 is formed so that a flange portion 295 is larger than the boss body portion 294.

The boss 292 includes a semicircular flat boss top surface 296, a flange portion curved side surface (flange portion side surface) 297 that is continuous with a circular-arc portion of the boss top surface 296, and a body portion curved side surface (body portion side surface) 298 that is continuous with the flange portion curved side surface 297, and a flat boss straight side surface 299 that is continuous with a straight portion of the boss top surface 36. The boss 292 is set so that the height from the base end portion to the boss top surface 296 is equal to a desired height. The boss 292 is set to be rotated by being inserted into the boss guide groove 287. Incidentally, the shape of the flange portion curved side surface 297 can be a shape cross-sectionally inclined like a circular-arc, or a shape cross-sectionally inclined like a hook, in addition to a cross-sectionally taperedly inclined shape. The shape of the flange portion curved side surface 297 is not limited to a specific shape, as long as the shape thereof is adapted such that the surface 297 abuts against the boss guide groove 287 thereby to restrain the detachable connector 282 from moving in a boss protruding direction in which the boss 292 protrudes.

The boss guide groove 287 includes a boss insertion hole 300 opened in the fitting abutment face 289, a guide groove bottom surface 301 which the boss top surface 296 slides on or is opposed to, a guide groove side surface 42 which is cross-sectionally taperedly inclined and which the flange portion curved side surface 297 slides or is opposed to, a guide groove opening portion 303 which the body portion curved side surface 298 slides on or is opposed to, a guide groove guide surface 304 which the boss straight side surface 299 slides or is opposed to, a guide groove stopper face 305 on which the boss straight side surface 299 abuts, and a boss rotation supporting portion 306 which is formed on a continuous portion of the guide groove guide surface 304 and is contacted with the boss straight side surface 299 and serves as a fulcrum point at the rotation of the detachable connector. The guide groove side surface 302 is formed into a shape adjusted to that of the flange portion curved side surface 297.

Both of the guide groove guide surface 304 and the guide groove stopper face 305 are flat surfaces and are arranged and formed to be perpendicular to each other. The continuous parts of the guide groove guide surface 304 and the guide groove stopper face 305 meet at right angles. The boss rotation supporting portion 306 supports the boss straight side surface 299 in a line contact state. The guide groove stopper face 305 is enabled to restrain, when the boss straight side surface 299 abuts thereagainst, the drop-off of the boss 292. The guide groove stopper face 305 has the function of serving as a retaining face.

The drop-off of the boss 292 is supplementarily described hereinafter. The flange portion curved side surface 297 of the boss 292 and the boss guide groove side surface 302 of the boss guide groove 287 are not formed into a simply cross-sectionally taperedly inclined shape, and are formed into a shape (i.e., a shape enabling a set of the boss and the boss guide groove to function as a tightening structure portion) that causes tightening between the boss 292 and the boss guide groove 287. Due to occurrence of the tightening between the boss 32 and the boss guide groove 287, the generation of a looseness at this part (more specifically, a looseness in the boss protruding direction) can surely be restrained. An example of the shape enabling a set of the boss and the boss guide groove to function as a tightening structure portion is a shape adapted so that a gap is generated between the flange portion curved side surface 297 and the guide groove side surface 302, which are cross-sectionally taperedly inclined, just after the boss 292 is inserted into the boss guide groove 287, that this gap gradually decreases with the rotation of the boss 292, and that finally, the cross-sectionally taperedly inclined surfaces push each other and are attached tightly to each other. In this case, it is advisable that for example, the inclination angle of one of the cross-sectionally taperedly inclined surfaces is set at a constant value, and that the inclination angle of the other cross-sectionally taperedly inclined surface is set to be variable.

The boss 292 and the boss guide groove 287 are arranged and formed in the vicinity of the fitting abutment face 289 in the present embodiment (the boss 292 and the boss guide groove 287 are formed in the vicinity of the fitting abutment face 289 in order to assure a large terminal receiving margin, and however, the positions of the boss 292 and the boss guide groove 287 are not limited to those illustrated in the figure). Further, the boss 292 and the boss guide groove 287 are arranged and formed at a central position in the direction of height of each of the housing side portions 291 and 286 (i.e., the position of one of the mating terminal insertion holes 290 is determined to be the central position) in the present embodiment. Each of the retaining protrusion 288 and the retaining groove 293 is arranged and formed to be positioned on a rotational trajectory around an associated one of the boss 292 and the boss guide groove 287. Each of the retaining protrusion 288 and the retaining groove 293 is arranged and formed at a position away from the associated one of the boss 292 and the boss guide groove 287. In the present embodiment, each of the retaining protrusion 288 and the retaining groove 293 is arranged at a side that is opposite to the fitting abutment face 289 and that is closer to the terminal insertion face 307.

Next, a process of connecting the base connector 281 and the detachable connector 282 is described hereinafter according to the aforementioned configuration and structure.

Figure 31B:
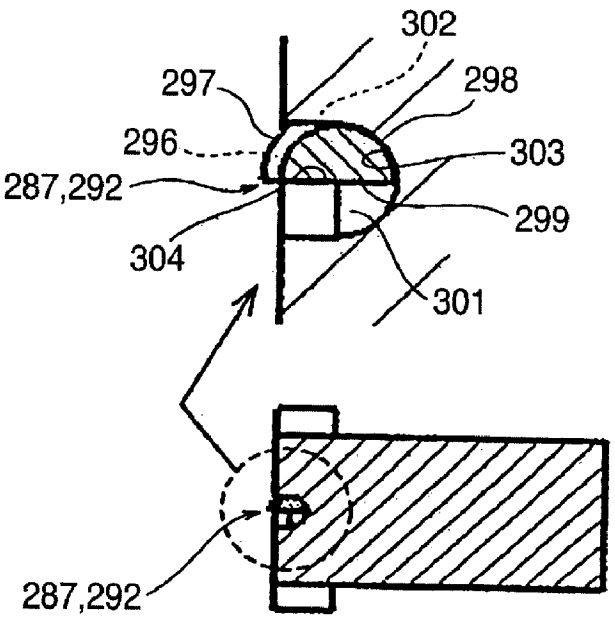
FIGS. 31A and 31B are explanatory views concerning a connecting process.
Figure 31A:
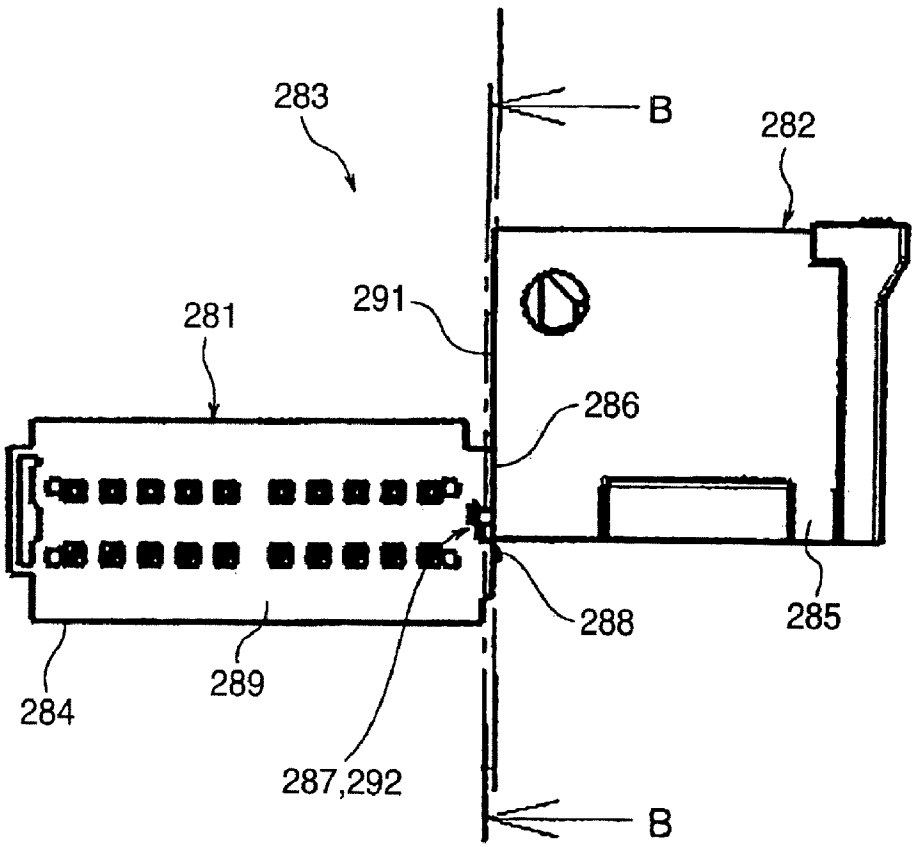

As illustrated in FIGS. 28A and 28B, the detachable connector 282 is erected by 90° with respect to the base connector 281. Then, the detachable connector 282 is moved in the direction of arrow P. When the detachable connector 282 is moved in the direction of arrow P, the boss 292 is inserted into the boss guide groove 287 of the base connector 281, as illustrated in FIGS. 30B and 31A. The boss 292 is passed through the boss insertion hole 300 and is guided into the boss guide groove 287. At that time, the boss 292 is adapted so that the boss straight side surface 299 slides on the guide groove guide surface 304. Further, the boss top surface 296 of the boss 292 slides on the guide groove bottom surface 301. Furthermore, the flange portion curved side surface 297 slides on the guide groove side surface 302. Moreover, the body portion curved side surface 298 slides on the guide groove opening portion 303 (it is assumed that the boss 292 and the boss guide groove 287 are not put into a state, in which each of the boss 292 and the boss guide groove 287 slides on an associated one of all of the surfaces of the boss guide groove 287, due to the structure of the combined-type connector, and that an extremely small gap is generated between one of all of the surfaces of the boss 292 and an associated one of all of the surfaces of the boss guide groove 287).

Figure 32B:
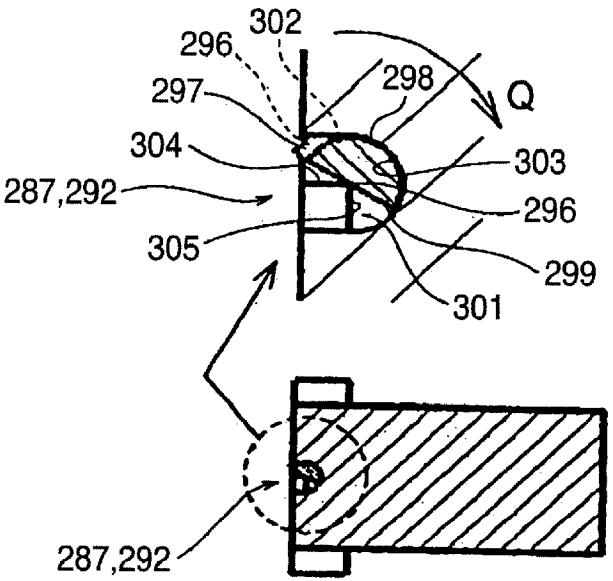
FIGS. 32A and 32B are explanatory views concerning a connecting process.
Figure 32A:
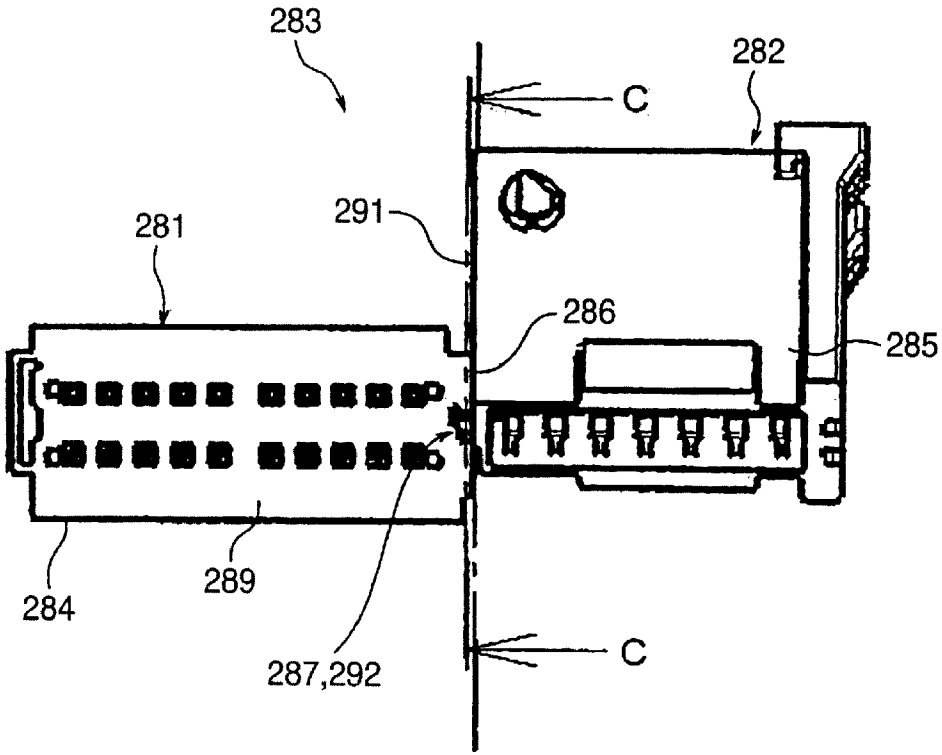

As illustrated in FIGS. 28C, 30C, and 32, the boss 292 rotates using the boss rotation supporting point portion 306, with which the boss straight side surface 299 is contacted, as a supporting point when the detachable connector 282 is rotationally moved in the connecting direction designated by arrow Q. At that time, the boss 292 is adapted so that the boss top surface 296 further slides on the guide groove bottom 301, that the flange portion curved side surface 297 further slides on the guide groove side surface 302, and that the body portion curved side surface 298 further slides on the guide groove opening portion 303.

Figure 33B:
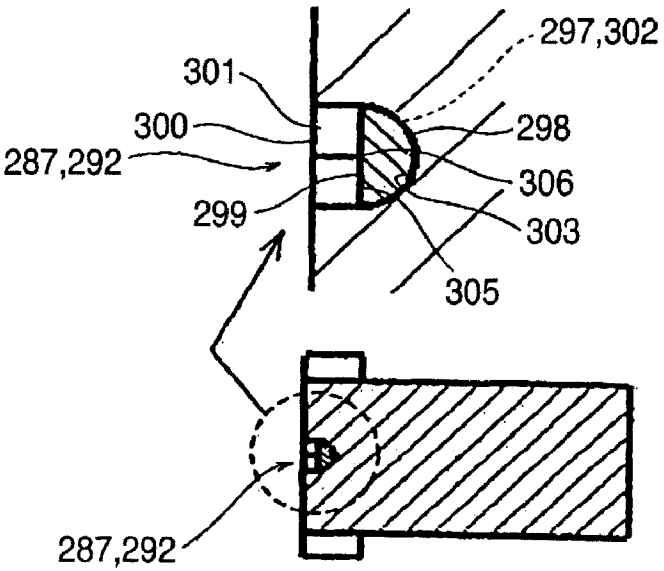
FIGS. 33A and 33B are explanatory views concerning a connecting process.
Figure 33A:
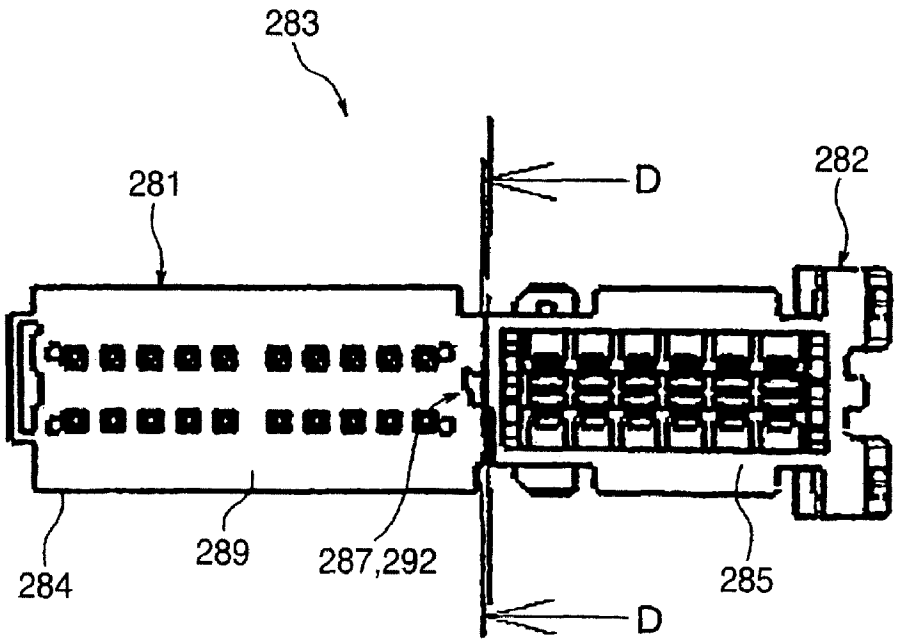

As illustrated in FIGS. 30D and 33, the detachable connector 282 is rotated with respect to the base connector 281 to a position in which the detachable connector 282 and the base connector 282 are in a parallel state. Consequently, the boss 295 is adapted so that the boss top surface 296 further slides on the guide groove bottom surface 301, that the flange portion curved side surface 297 further slides on the guide groove side surface 302, that the body portion curved side surface 298 further slides on the guide groove opening portion 303, and that the boss straight side surface 299 abuts against the guide groove stopper face 305. When the boss straight side surface 299 abuts against the guide groove stopper surface 305, the boss 292 is restrained from dropping off the boss insertion hole 300. Further, because the flange portion curved side surface 297 engages with the guide groove side surface 302, the boss 292 is also restrained from dropping off the guide groove opening portion 303.

When the detachable connector 282 and the base connector 281 is in a parallel state, the retaining protrusion 288 of the detachable connector 282 engages with the retaining groove 293 of the base connector 281. Thus, a retained state is caused (see FIG. 34 (description concerning FIG. 34 is given below)). Consequently, the detachable connector 282 and the base connector 281 are completely connected to each other. Accordingly, the formation of the combined-type connector 283 is completed.

The boss 292 and the boss guide groove 287 have the retaining structure in which the abutment between the aforementioned surfaces is caused. Thus, the invention can suppress a looseness in the connecting direction, in which the terminal metal fittings are connected to each other, to a small amount, as compared with the conventional combined-type connector. Accordingly, the invention has an advantage that a contact margin between the terminal metal fittings can be prevented from being reduced.

Next, it is described hereinafter how an amount of displacement of the mating terminal receiving portion in the base connector 281 from a reference is made small in the case of using the detachable connector 282, which is connected to the base connector 282 by being rotated, as the reference. FIGS. 34A and 34C are explanatory views each illustrating an amount of displacement of the mating terminal receiving portion of the combined-type connector 23 according to the invention. Further, FIGS. 35A to 35C are explanatory views illustrating a comparative example of the combined-type connector shown in FIGS. 34A and 34C, which concern a retaining looseness.

Figure 34B:
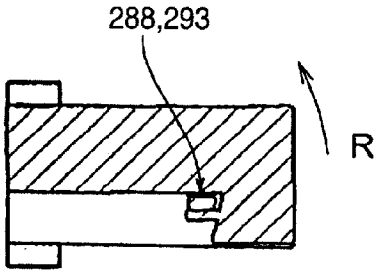
FIGS. 34B and 34D are cross-section views of 34A and 34C, respectively, both of which show a retaining looseness in the retained state of the retaining protrusion and the retaining groove.
Figure 34D:
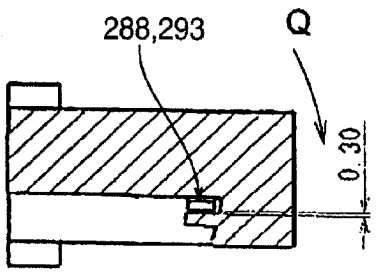
Figure 34A:
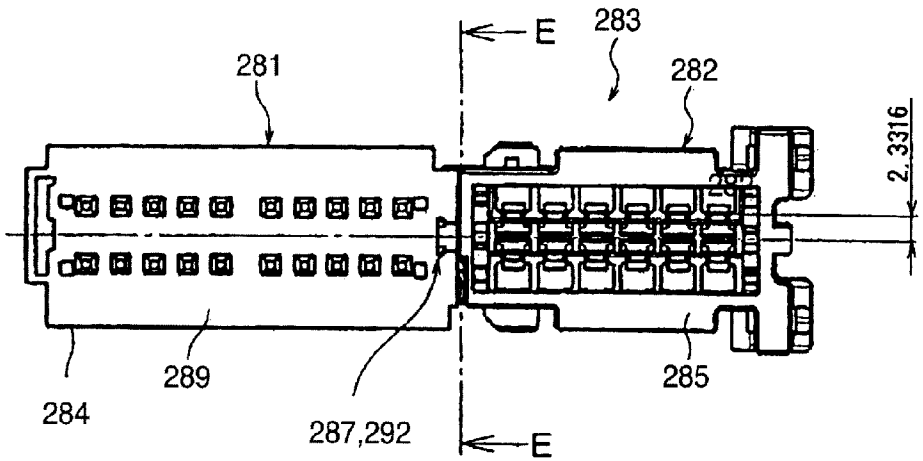
FIGS. 34A and 34C are explanatory views both of which concerns an amount of displacement of a mating terminal receiving portion.
Figure 34C:
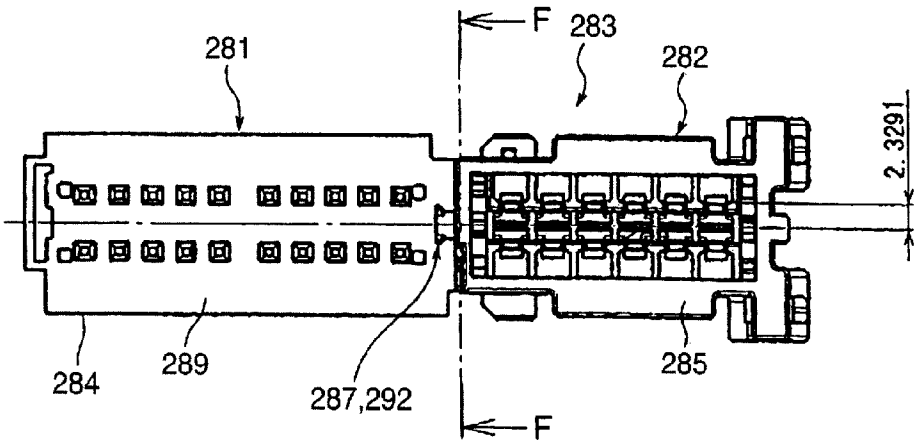

As illustrated in FIGS. 34B and 34D, a retaining looseness in the retained state of the retaining protrusion 288 and the retaining groove 293, which serve as a portion for restraining the rotation of the detachable connector, is set at 0.30 mm. When the detachable connector 282 is shaky in the disconnecting direction designated by arrow R in the case of setting the retaining looseness at such a value, the dimension of the position of the mating terminal receiving portion with respect to the center line in a horizontal direction of the combined-type connector 283 is 2.3316 mm. On the other hand, when the detachable connector 282 is shaky in the connecting direction designated by arrow Q in the case of setting the retaining looseness at such a value, the dimension of the position of the mating terminal receiving portion with respect to the center line in the horizontal direction of the combined-type connector 283 is 2.3291 mm. Accordingly, it is found that an amount of displacement (i.e., a displacement amount) of the position of the mating terminal receiving portion is 0.0025 mm (=2.3316−2.3291). The combined-type connector 283 according to the invention employs a method of connecting the base connector and the detachable connector with each other by the rotation of the detachable connector. Further, the retaining protrusion 288 and the retaining groove 293 are moved away from the center of rotation. Thus, even in the case of setting the retaining looseness at 0.30 mm, an amount of the caused displacement of the mating terminal receiving portion is only 0.0025 mm. Therefore, the amount of the displacement thereof is small. Consequently, the fitting and the electrical connection of the combined-type connector to the mating connector can be achieved in a favorable state.

Figure 35A:
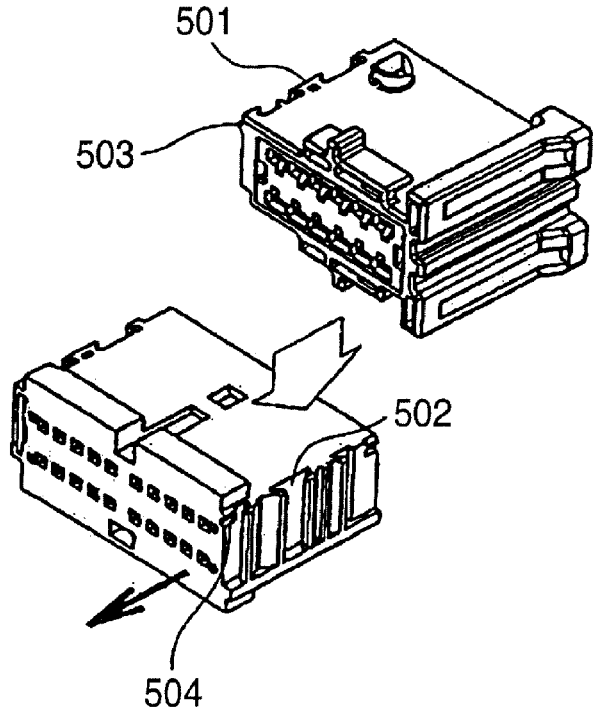
FIGS. 35A to 35C are explanatory views illustrating a comparative example of the combined-type connector shown in FIGS. 35A and 35B, which concerns a retaining looseness.
Figure 35B:
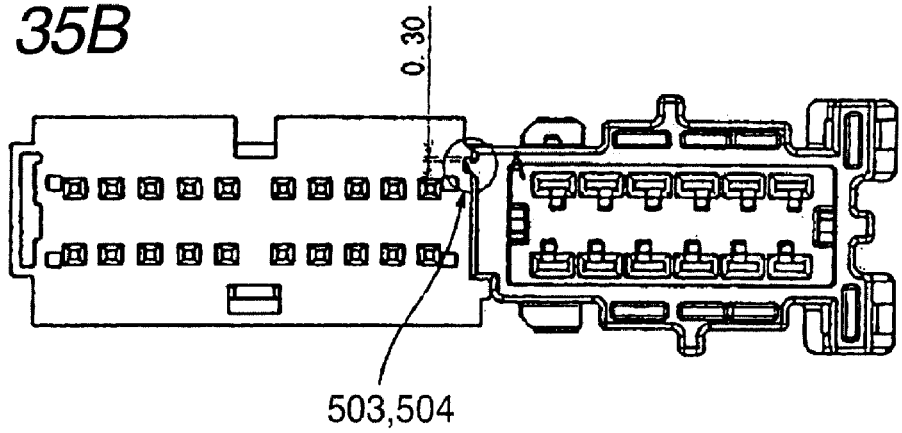
Figure 35C:
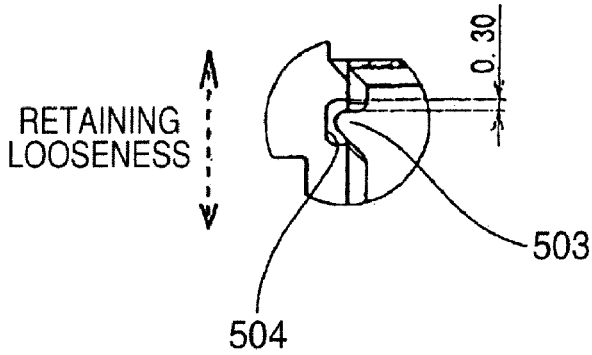
Figure 36A:
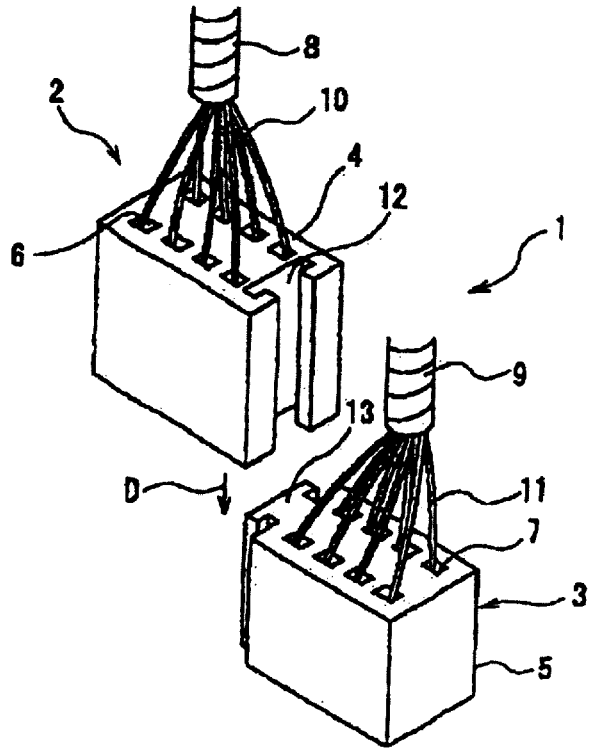
FIGS. 36A to 36C are views each illustrating a conventional combined-type connector
Figure 36B:
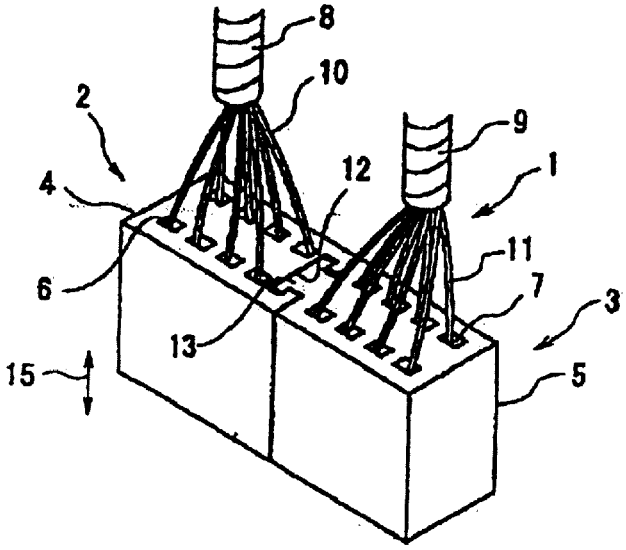
Figure 36C:
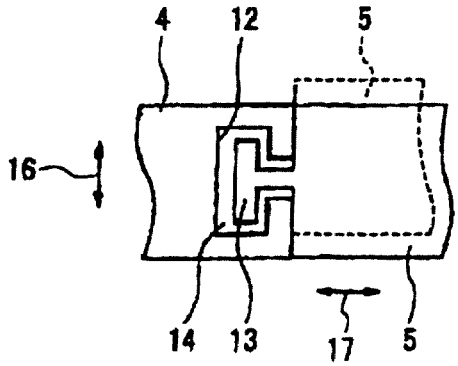

As illustrated in FIGS. 35A to 35C, in a slide fitting structure in which a fitting protrusion 501 is fit to a fitting groove 502, a retaining looseness in the retained state of a retaining protrusion 503 and a retaining groove 504 is set at 0.30 mm, similarly to the case illustrated in FIGS. 34A through 34D, the position of the mating terminal receiving portion is displaced by a retaining looseness of 0.30 mm.

As is understood according to the aforementioned amount of the displacement, the invention can suppress the amount of the displacement of the mating terminal receiving portion can be suppressed to a small value, as compared with the conventional combined-type connector. Consequently, the invention can achieve an effect of enhancing the reliability of terminal metal fittings.

In addition, it is apparent that various modifications of the invention can be made without changing from the gist thereof.

What is claimed is:

1. A combined type connector comprising: a base connector housing comprising:

a first main body;

a boss groove provided on a first outer surface of the first main body;

a first guide part provided on the first outer surface; and a first stopping part provided on the first outer surface; and a detachable connector housing comprising:

a second main body;

a boss provided on a second outer surface of the second main body;

a second guide part provided on the second outer surface; and a second stopping part provided on the second outer surface, wherein the base connector housing and the detachable connector housing are connected by engaging the boss with the boss groove and pivoting the detachable connector housing about the boss from a first position to a second position so that the first guide part slides along the second guide part; and the first stopping part and the second stopping part are engaged so as to stop the detachable connector pivoting at the second position, wherein the first and the second guide part are formed in an arc shape, which center is located slightly gapped from the boss as a center of the detachable connector rotation.

2. The combined type connector according to claim 1, wherein the boss includes:

a body part integrally provided on the second outer surface, and a flange part integrally provided on the body part.

3. The combined type connector according to claim 2, wherein the flange part has a top surface and a flange side surface continuous from the top surface, and the body part has a body side surface continuous from the flange side surface, and the boss groove has a boss insertion hole through which the boss is inserted into the boss groove, a bottom surface on which the top surface slides, a first guide side surface on which the flange side surface slides, and a second guide side surface on which the body side surface slides.

4. The combined type connector according to claim 3, wherein the first outer surface has a first aspect on which the boss groove is formed and a second aspect on which a mating terminal insertion hole is provided, wherein the boss insertion hole straddles an edge which is shared by the first and the second aspect of the first outer surface.

5. The combined type connector according to claim 4, wherein the top surface has an arc peripheral part and the flange side surface is continuous from the arc peripheral part.

6. The combined type connector according to claim 3, wherein the contact between the boss flange part and the boss housing is tightened when the detachable connector housing pivots about the boss.

7. The combined type connector according to claim 3, wherein the boss and the boss groove are formed to be in a press-fit state.

8. The combined type connector according to claim 3, wherein the flange part has a protrusion at a periphery of the flange part so that the connection between the boss flange part and the boss housing part is tightened when the detachable connector housing pivots about the boss.

9. The combined type connector according to claim 4, wherein the flange part has a slit so as to alleviate a force caused by tightening.

10. The combined type connector according to claim 5, wherein the flange part has a slit so as to alleviate a force caused by tightening.

11. The combined type connector according to claim 3, wherein the flange part has a semi-circle shape and the boss insertion hole has a boss rotation supporting portion functioning as a fulcrum for the boss rotation.

12. The combined type connector according to claim 1, wherein the first and the second guide part are formed so that the contact between the first and the second guide part is tightened when the detachable connector housing rotates about the boss.

13. The combined type connector according to claim 1, wherein at least one of the first and the second guide part includes a stopper which restrains the rotation of the detachable connector.

14. The combined type connector according to claim 1, wherein at least one of the first and the second guide part includes an erroneous connection preventing portion which prevent erroneous connection between different type connectors.

15. The combined type connector according to claim 1, wherein the boss, the first stopping part, and the first guide part are provided on a first aspect of the first outer surface; and the boss groove, the second stopping part, and the second guide part are provided on a second aspect of the second surface, wherein the first aspect and the second aspect oppose each other when the detachable and the base connector is connected.

16. The combined type connector according to claim 15, wherein the first guide part is provided on a first edge of the first aspect and the second guide part is provided on a second edge of the second aspect.

17. The combined type connector according to claim 15, wherein the first stopping part is provided on a half part of the first aspect including the first edge and the second stopping part is provided on a half part of the second aspect including the second edge.

18. The combined type connector according to claim 1, wherein the first guide part is a first guide rail protruded from the first outer surface; and the second guide part is a second guide rail recessed from the second outer surface; and the first and second guide rail contacts and slides along each other when the detachable connector housing pivots.

19. The combined type connector according to claim 1, wherein the first guide part is a first guide rail protruded from the first outer surface; and the second guide part is a second guide rail protruded from the second outer surface; and the first and second guide rail contacts and slides along each other when the detachable connector housing rotates.

* * * * *